US005250399A

United States Patent [19]

Szajewski et al.

[11] Patent Number: 5,250,399

[45] Date of Patent: * Oct. 5, 1993

[54] PHOTOGRAPHIC MATERIAL AND PROCESS COMPRISING A UNIVERSAL COUPLER

[75] Inventors: Richard P. Szajewski; Jerrold N. Poslusny, both of Rochester; David A. Steele, Webster; Teh-hsuan Chen, Fairport; Paul A. Burns; Ronald E. Leone, both of Rochester; William J. Begley, Webster, all of N.Y.

[73] Assignee: Eastman Kodak Company, Rochester, N.Y.

[ * ] Notice: The portion of the term of this patent subsequent to Sep. 29, 2009 has been disclaimed.

[21] Appl. No.: 723,080

[22] Filed: Jun. 28, 1991

[51] Int. Cl.[5] ..... G03C 7/32

[52] U.S. Cl. ..... 430/382; 430/544; 430/957

[58] Field of Search ..... 430/544, 957, 382, 543

[56] References Cited

U.S. PATENT DOCUMENTS

| | | | |
|---|---|---|---|
| 3,227,554 | 1/1966 | Barr et al. | 96/55 |
| 3,615,506 | 10/1971 | Abbott et al. | 96/56.5 |
| 4,248,962 | 2/1981 | Lau | 430/282 |
| 4,409,323 | 10/1983 | Sato et al. | 430/544 |
| 4,477,563 | 10/1984 | Ichijima et al. | 430/544 |
| 4,482,629 | 11/1984 | Nakagawa et al. | 430/542 |
| 4,798,784 | 1/1989 | Kishimoto et al. | 430/382 |
| 4,812,389 | 3/1989 | Sakanoue et al. | 430/382 |
| 4,861,701 | 8/1989 | Burns et al. | 430/543 |
| 5,026,628 | 6/1991 | Begley et al. | 430/382 |
| 5,151,343 | 9/1992 | Begley et al. | 430/544 |

OTHER PUBLICATIONS

*Research Discolosure,* Dec. 1989, Item No. 308119, Kenneth Mason Publications Emsworth, Hampshire P010 7DQ, England.

*Primary Examiner*—Richard L. Schilling
*Attorney, Agent, or Firm*—Michael D. Alexander

[57] ABSTRACT

A photographic coupler (A) capable, upon oxidative coupling, of forming a dye that can be washed out of a photographic element containing the coupler upon processing, comprises, in the coupling position, a coupling-off group that comprises, in sequence, a releasable ballasted carbamate timing group and a releasable benzotriazole, triazole or tetrazole development inhibitor group. Such a coupler is useful in photographic silver halide materials and processes to provide improved images.

7 Claims, No Drawings

PHOTOGRAPHIC MATERIAL AND PROCESS COMPRISING A UNIVERSAL COUPLER

This invention relates to new photographic couplers that are capable of forming dyes that are capable upon photographic processing of being washed out of the photographic element containing the couplers and such couplers that have a coupling-off group that comprises a releasable carbamate timing group and a releasable benzotriazole, triazole or tetrazole development inhibitor group, and to photographic elements and processes comprising such couplers.

Various photographic couplers are known in photographic materials and processes. Such couplers upon oxidative coupling form dyes, such as cyan, magenta and yellow image dyes in the photographic materials and processes. Another class of such couplers are couplers that release a development inhibitor group for improvements in image formation during processing. Typically such couplers are development inhibitor releasing (DIR) couplers such as described in, for example, U.S. Pat. No. 3,227,554 and DIR coupler that have timing groups that enable timing of release of the development inhibitor group, such as described in, for example, U.S. Pat. Nos. 4,248,962; 4,409,323 and 4,861,701. A problem has been encountered with such development inhibitor releasing couplers in that the compound, typically a dye, that remains after the release of the development inhibitor group causes adverse effects on the photographic element and the image formed.

It has been desirable to either remove the compound, such as the dye, that is formed after release of the development inhibitor group or to form a compound that is essentially colorless in the element. The selection of couplers that enable formation of colorless compounds or form removable compounds, such as compounds capable of being washed out of the photographic element upon processing, without adversely affecting the photographic element are very limited. For example, the DIR couplers of U.S. Pat. Nos. 3,615,506 and 4,477,563 do not enable removal of the dye formed from the photographic element and a timing group, such as described in U.S. Pat. No. 4,248,962 does not solve this problem. While couplers that form water-soluble dyes and release a development inhibitor group are known, such as described in U.S. Pat. No. 4,482,629, such couplers do not contain a combination of groups that satisfies all the requirements of: 1) wash-out capability with desired coupling reactivity upon processing, 2) a coupling-off group that has a timing group bonded at the coupling position that enables desired reactivity as well as fast release with ballasting of the coupler, 3) stability in a photographic element, 4) useful reactivity with image-forming couplers in a photographic element, and 5) a releasable development inhibitor group that provides improved image acutance without adverse effects on the desired image. It has been desirable to provide such an image modifying coupler, especially a development inhibitor releasing coupler, termed herein a universal Z coupler, that satisfies all of these requirements.

The present invention solves these problems by means of a photographic element comprising a support bearing at least one photographic silver halide emulsion layer and a coupler (A) capable upon oxidative coupling of forming a dye that can be washed out of the element upon processing wherein the coupler (A) comprises, in the coupling position, a coupling-off group that comprises, in sequence, a releasable ballasted carbamate timing group and a releasable benzotriazole, triazole or tetrazole development inhibitor group. Such a coupler (A) is preferably a naphtholic coupler comprising in the 2-position a —$COR^1$ group that enables the coupler upon oxidative coupling to form a dye that is capable of being washed out of the photographic element upon processing and in the 4-position a coupling-off group represented by the formula:

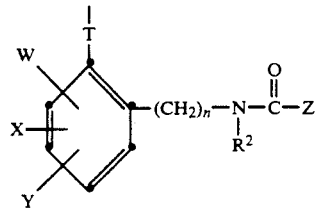

wherein

W, X and Y individually are hydrogen or a substituent that does not adversely affect the described coupler and its properties; for example, W, X and Y individually are hydrogen; halogen, particularly chlorine or bromine; —$NO_2$; —$SOR^3$; —$OR^3$; —$SO_2R^3$; —$SO_2NR^3R^4$; —$NR^4COR^3$; —$NR^4SO_2R^3$; —$NR^3R^4$; —$COOR^3$; —CN; or —$CONHR^3$;

$R^1$ represents the atoms completing a water-solubilizing group;

$R^2$ is substituent that does not adversely affect the coupler, typically unsubstituted or substituted alkyl, such as alkyl containing 1 to 40 carbon atoms, or unsubstituted or substituted aryl, such as aryl containing 6 to 40 carbon atoms, for instance unsubstituted or substituted phenyl; preferably $R^2$ is a ballasting group known in the photographic art;

$R^3$ is unsubstituted or substituted alkyl, such as alkyl containing 1 to 40 carbon atoms, or unsubstituted or substituted aryl, such as aryl containing 6 to 40 carbon atoms, for instance unsubstituted or substituted phenyl;

$R^4$ is hydrogen, unsubstituted or substituted alkyl, preferably containing 1 to 15 carbon atoms, or unsubstituted or substituted aryl, preferably containing 6 to 15 carbon atoms, such as unsubstituted or substituted phenyl;

Z is a releasable benzotriazole, triazole or tetrazole development inhibitor group, not phenylmercaptotetrazole;

n is 0 or 1;

T is O, S, O—$CH_2$—, $$O-\underset{\underset{O}{\|}}{C}-,\ -NHSO_2-,\ \text{or}\ -NH\underset{\underset{O}{\|}}{C}-;$$

and at least one of W, X, Y, and $R^2$ is a ballasting group, especially a ballasting group known in the photographic art.

A benzotriazole development inhibitor group herein means any 1- or 2- benzotriazole development inhibitor group, such as known in the photographic art, as described in, for example, U.S. Pat. Nos. 4,477,563 and 4,812,389. These include, for example, a benzotriazole development inhibitor group represented by the formula:

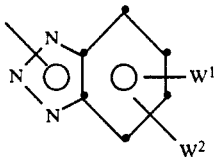

wherein $W^1$ and $W^2$ individually are hydrogen or a substituent that does not adversely affect the coupler or inhibitor, such as halogen, especially chlorine or bromine, unsubstituted or substituted alkyl, especially alkyl containing 1 to 30 carbon atoms, or unsubstituted or substituted alkoxy, such as alkoxy containing 1 to 30 carbon atoms, or unsubstituted or substituted alkoxycarbonyl, especially alkoxycarbonyl containing 1 to 30 carbon atoms.

A triazole development inhibitor group herein means any triazole development inhibitor group known in the photographic art. Such a group is represented by the formula:

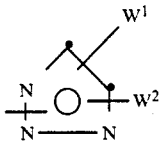

wherein $W^1$ and $W^2$ are as described.

A tetrazole development inhibitor group herein means any tetrazole development inhibitor group known in the photographic art, not including phenylmercaptotetrazole. Such a group is represented by the formula:

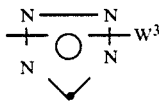

wherein $W^3$ is hydrogen, alkyl or aryl.

Couplers that do not contain the described combination of groups do not satisfy one or more of the described requirements in a photographic element, particularly a color photographic silver halide element.

Combinations of the described couplers are also useful.

As used herein the term "coupler" refers to the entire compound including the coupler moiety and the coupling-off group including the Z development inhibitor moiety. The term "coupler moiety" refers to that portion of the compound other than the coupling-off group.

Any photographic coupler moiety can be used for the coupler moiety of coupler (A) provided that the coupler moiety upon oxidative coupling forms a dye that is capable of being washed out of the photographic element upon processing. Typical photographic coupler moieties upon oxidative coupling form cyan, magenta or yellow dyes capable of being washed out of the element. Typical coupler moieties contain a water-solubilizing group, such as a carboxy or sulfonic acid group or $—COR^1$ wherein $R^1$ is typically $NHCH_3$, $NH_2$, $OCH_3$, $OC_2H_5$, $NHCH_2CH_2CO_2C_2H_5$.

Preferred coupler moieties are naphtholic coupler moieties containing a substituent in the 2-position that is a water-solubilizing group that enables dye formed from the coupler upon oxidative coupling to be washed out of the element upon processing. Examples of such useful substituents $—COR^1$ in the 2- position of the naphtholic coupler include: $—CONHCH_3$, $—CONH_2$, $—CONH(CH_2)_m—J$,

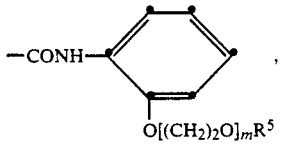

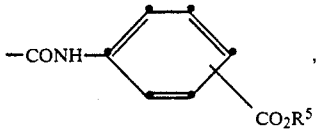

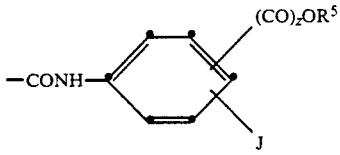

or

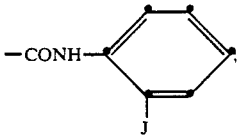

wherein $R^5$ is hydrogen, methyl or ethyl and m is 1, 2 or 3; z is 0 or 1; and, J is —H, —CN, $SOR^5$, $SO_2R^5$, $SO_3R^5$, $CO_2R^5$, —Cl, —Br, or $OR^5$.

A preferred coupler, such as a naphtholic coupler, comprises in the coupling position a coupling-off group comprising in sequence a ballasted carbamate group and bonded to the carbamate group a releasable Z development inhibitor group. Examples of useful coupling-off groups include:

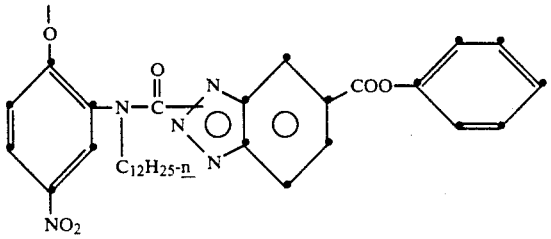

-continued
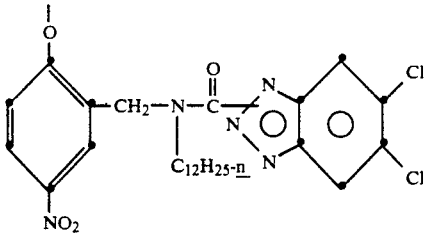
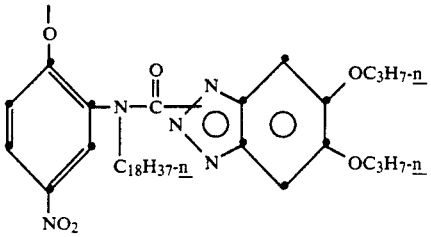
or
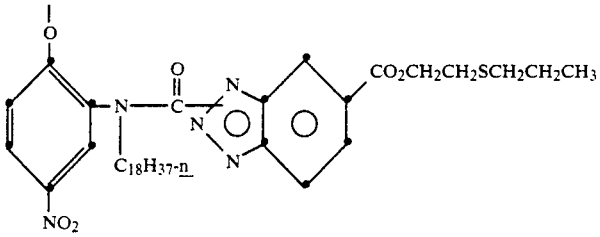
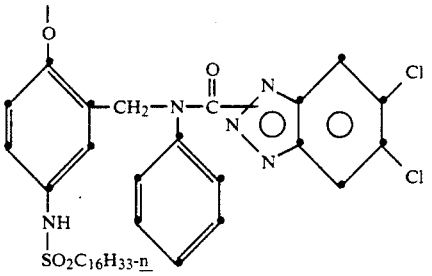
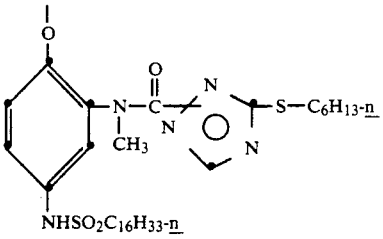
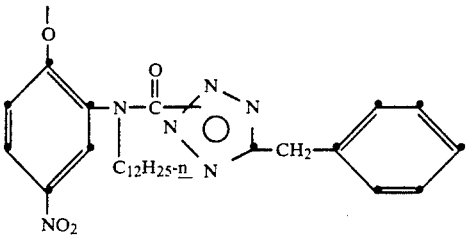

-continued

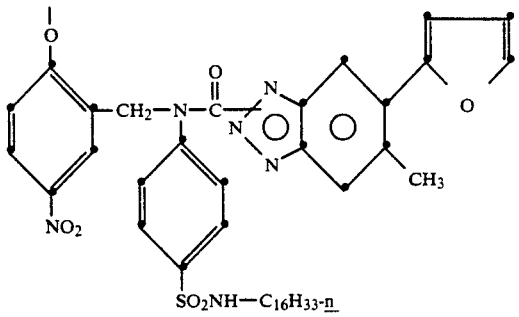

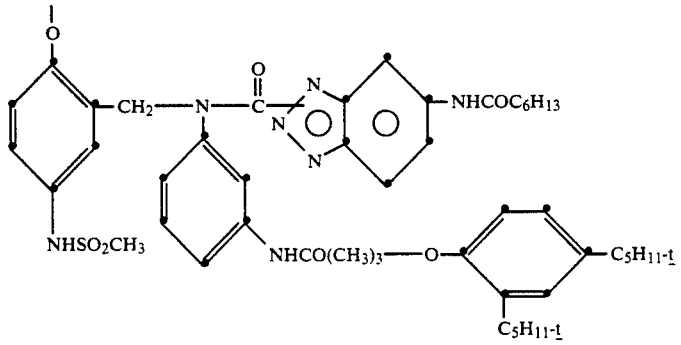

The coupler moiety can be monomeric, or it can be part of a dimeric, oligomeric or polymeric coupler in which case more than one group containing Z can be contained in the coupler.

The coupling-off group is joined to the coupler moiety at the coupling position of the coupler moiety. The coupling-off group is released from the coupling position by oxidative coupling reactions known in the photographic art.

Useful coupler moieties include, for example, those described in the following patents in which the ballast groups on the coupler moieties are removed and replaced with water solubilizing groups as described above to enable the dyes formed from the coupler moieties to be washed out of the photographic element. In addition these patents and publications describe image dye-forming couplers that are useful in combination with the couplers of the invention:

I. COUP's

A. Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999 and "Farbkuppler-eine Literaturübersicht," published in Agfa Mitteilungen, Band III, pp. 156–175 (1961).

Preferably such couplers are phenols and naphthols that form cyan dyes on reaction with oxidized color developing agent.

B. Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler-eine Literaturübersicht," published in Agfa Mitteilungen, Band III, pp. 126–156 (1961).

Preferably such couplers are pyrazolones and pyrazolotriazoles that form magenta dyes upon reaction with oxidized color developing agents.

C. Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler-eine Literaturü bersicht," published in Agfa Mitteilungen, Band III, pp. 112–126 (1961).

Preferably such yellow-dye forming couplers are acylacetamides, such as benzolyacetamides and pivaloylacetamides.

D. Couplers which form colorless products upon reaction with oxidized color developing agent are described in such representative patents as: U.K. Patent No. 861,138; U.S. Pat. Nos. 3,632,345; 3,928,041; 3,958,993 and 3,961,959.

Preferably such couplers are cyclic carbonyl containing compounds that form colorless products upon reaction with oxidized color developing agents.

The described image dye-forming couplers can be incorporated in the photographic element and/or in photographic processing solutions, such as developer solutions, so that upon development of the exposed photographic element they will be in reactive association with oxidized color developing agent. Couplers that are incorporated in photographic processing solutions should be of such molecular size and configuration that they will diffuse through photographic layers with the processing solution. When incorporated in the photographic element, the image dye-forming couplers and the couplers of the invention should be nondiffusible, that is they should be of such molecular size and configuration that they will not significantly diffuse or wander from the layer in which they are coated.

Upon processing, the image dye-forming coupler in the exposed areas of the photographic element typically forms an immobile dye image. However, the coupler of the invention in the image areas forms a mobile dye that is capable of washing out of the element during processing. Upon oxidative coupling in the image area the coupler of the invention releases the coupling-off group comprising the ballasted carbamate group and the Z development inhibitor group. The ballasted carbamate portion of the coupling-off group is immobile and remains in the location in which the coupler was coated. The Z development inhibitor group is released and performs its function enabling improved image acutance and other advantages.

Photographic elements of this invention can be processed by conventional techniques in which color forming couplers and color developing agents are incorporated in separate processing solutions or compositions or in the element. Photographic elements of this invention are especially useful as color negative elements that are processed in a conventional color negative photographic process.

Photographic elements in which the compounds of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer, where they will come into reactive association with oxidized color developing agent which has developed silver halide in the emulsion layer. The silver halide emulsion layer can contain or have associated with it, other photographic coupler compounds, such as dye-forming couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

A typical multilayer, multicolor photographic element can comprise a support having thereon a red-sensitive silver halide emulsion unit having associated therewith a cyan dye image-providing material, a green-sensitive silver halide emulsion unit having associated therewith a magenta dye image-providing material and a blue-sensitive silver halide emulsion unit having associated therewith a yellow dye image-providing material, at least one of the silver halide emulsion units having associated therewith a photographic coupler of the invention. Each silver halide emulsion unit can be composed of one or more layers and the various units and layers can be arranged in different locations with respect to one another.

The couplers of this invention can be incorporated in or associated with one or more layers or units of the photographic element. For example, a layer of unit affected by Z can be controlled by incorporating in appropriate locations in the element a scavenger layer which will confine the action of Z to the desired layer or unit. At least one of the layers of the photographic element can be, for example, a mordant layer, a barrier layer of a protective layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure*, January 1983, Item No. 22534, U.S. Pat. No. 4,434,226 and U.S. application Ser. No. 419,177 filed Oct. 10, 1989.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers and the like.

The coupler of the invention can be used in a photographic element in the same way that photographic couplers that release a development inhibitor group have been used in the photographic art.

In the following discussion of suitable materials for use in the emulsions and elements of this invention, reference will be made to *Research Disclosure*, December 1978, Item 17643, published by Industrial Opportunities Ltd., Homewell Havant, Hampshire, P09 1EF, U.K., the disclosures of which are incorporated herein by reference. This publication will be identified hereafter by the term "Research Disclosure".

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethylaniline hydrochloride; 4-amino-3-methyl-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-3-β-(methanesulfonamido)-ethyl-N,N-diethylaniline hydrochloride; and 4-amino-N-ethyl-N-(2-methoxyethyl)-m-toluidine di-p-toluenesulfonic acid.

With negative working silver halide the processing step described above gives a negative image. To obtain a positive (or reversal) image, this step can be preceded by development with a non-chromogenic developing agent to develop exposed silver halide, but not form a dye, and then uniformly fogging the element to render unexposed silver halide developable. Alternatively, a direct positive emulsion can be employed to obtain a positive image.

The described photographic materials and processes can be used with photographic silver halide emulsions and addenda known to be useful in the photographic art, as described in, for example, *Research Disclosure*, December 1989, Item No. 308,119, the disclosures of which are incorporated herein by reference.

Couplers as described can be prepared by reactions and methods known in the organic compound synthesis art. The following methods illustrate synthesis of couplers of the invention:

Typically, the couplers are prepared by first attaching the ballasted coupling-off group without the inhibitor group present to the coupling position of the coupler moiety. The product is converted to a reactive derivative which is condensed with an appropriate inhibitor group to form the desired couplers. Alternatively, a reactive derivative of the inhibitor group may be formed first and then this material is reacted with the coupler containing the ballasted coupling-off group. The following syntheses illustrate the method of preparation.

Synthesis I

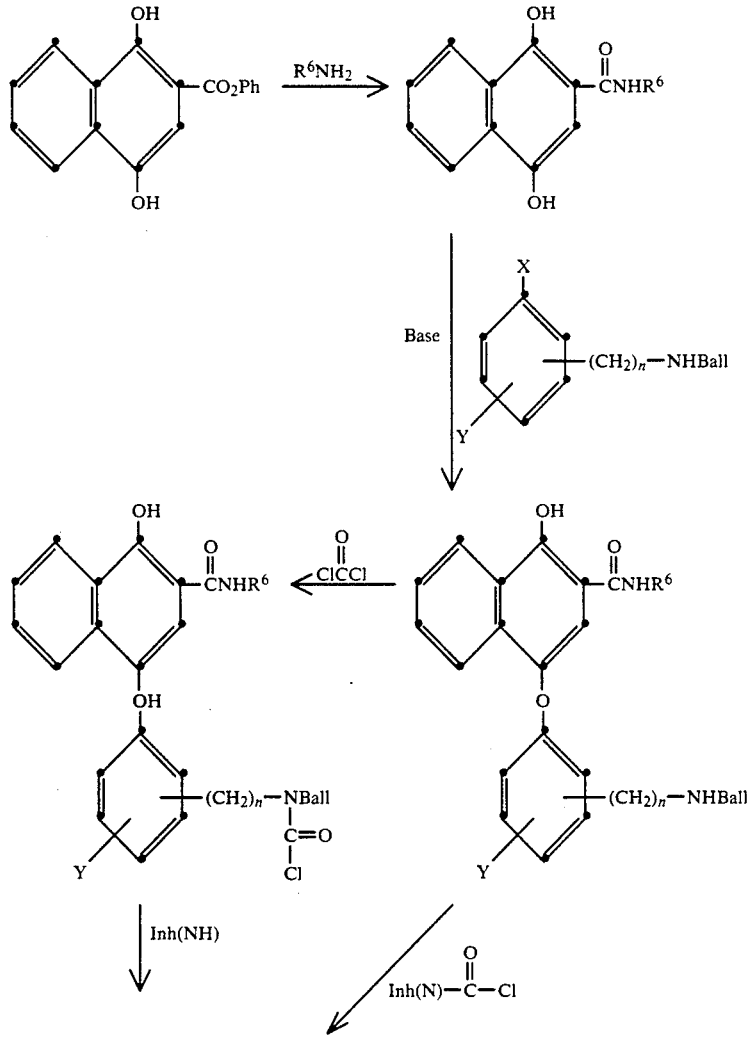

-continued

Synthesis 1

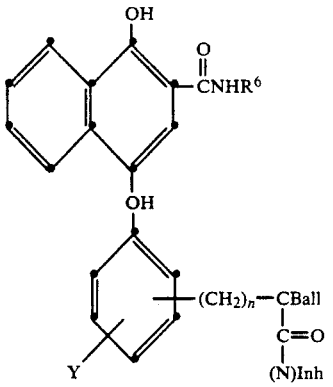

wherein $R^6$ is hydrogen or a low molecular weight group that enables the dye formed upon processing of a photographic element containing the coupler to be washed out of the element, such as $CH_3$, $(CH_2)_2CO_2C_2H_5$, and the like;

X is Cl or F;

n is 0 or 1;

Y is an electron withdrawing group such as $NO_2$ or Cl;

Ball is an appropriate ballast group;

Inh is a nitrogen containing inhibitor, particularly Z as described.

Ph herein is phenyl.

Illustrative examples of syntheses of couplers of the invention are as follows:

SYNTHESIS EXAMPLE A

Inventive Compound I-11

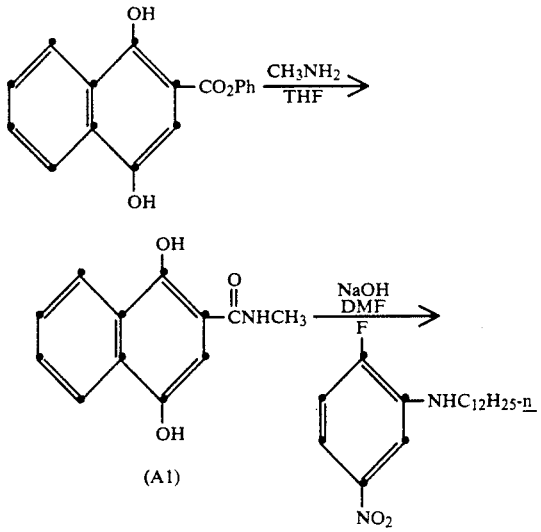

(A1) (A2)

-continued

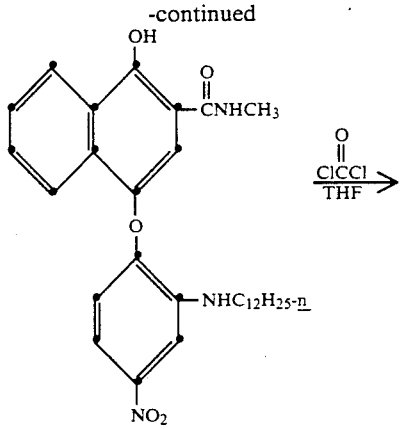

(A3)

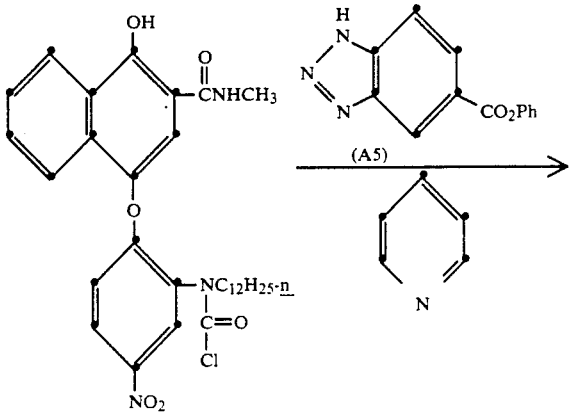

(A4)

-continued

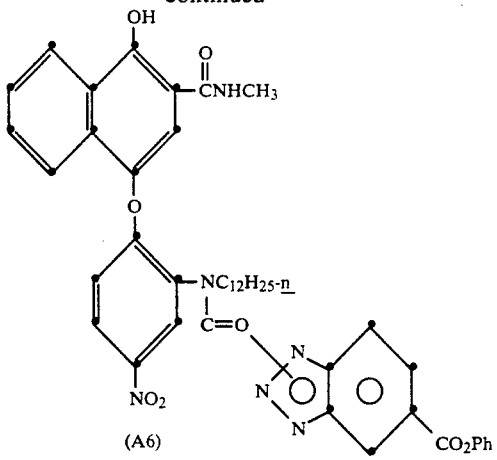

(A6)

Compound (A1)

Phenyl 1,4-dihydroxy-2-naphthoate (30.0 g, 0.107 mol) was taken up in deoxygenated tetrahydrofuran (300 mL). Under a nitrogen atmosphere, 40% aqueous methylamine (35 mL, 0.451 mol) was added dropwise over a 15 minute period. The resulting solution was stirred for 1 hour. At the end of this period the reaction was poured into ice cold 2N hydrochloric acid (2.5 L). The resulting precipitate was filtered off, washed thoroughly with water, and air dried. This material was pure enough to be used in the next step. Yield 23.0 g (99%).

Compound (A3)

Compound (A1) (67.3 g, 0.31 mol) and compound (A2) (94.5 g, 0.31 mol) were dissolved in N,N-dimethylformamide (800 mL). Aqueous 50% sodium hydroxide (50 mL, 25.0 g, 0.62 mol) was added dropwise. The resulting reaction mixture was allowed to stir overnight at room temperature. TLC (silica gel-EtOAc/513 ligroin; 30:70) showed a major product spot at Rf 0.60. The reaction mixture was poured into a mixture of 10% hydrochloric acid (2 L) and ethyl acetate (500 mL). The product crystallized and was filtered off. Yield 75.0 g (46%).

Compound (A4)

Compound (A3) (60.0 g, 0.115 mol) was dissolved in tetrahydrofuran (300 mL). A solution of phosgene in toluene (22%, 154 mL, 0.345 mol) was added in one portion The reaction mixture was stirred for 1 hour at room temperature. The resulting solution was concentrated on a rotary evaporator. Dichloromethane (500 mL) was added to the residue. The mixture was filtered to remove insoluble material. The solvent was removed under reduced pressure to give an oil which was used without further purification. TLC (ethyl acetate/513 ligroin; 15:85) showed a major spot at Rf 0.30.

Compound (A6)

Compound (A4) from above (0.115 mol) was dissolved in dry pyridine (250 mL). Compound (A5) (27.5 g, 0.115 mol) was added in one portion. The reaction mixture was stirred overnight at room temperature. The mixture was poured into dilute hydrochloric acid (1200 mL). The aqueous mixture was extracted with ethyl acetate. The extracts were dried over anhydrous magnesium sulfate and then were filtered. The solvent was removed under vacuum to give an oil. This oil was dissolved in dichloromethane and was chromatographed over silica gel using dichloromethane as an eluant. The fractions corresponding to the 3 different isomers of (A6) were combined and were concentrated to an oil. This oil was dissolved in a minimum amount of ether and P950 ligroin was added until an oil came out of solution. This mixture was stirred overnight at room temperature; the oil solidified. The mixture was filtered and the collected solid was slurried with methanol. The product was filtered off and dried to give a yellow solid. Yield 40.0 g (44%). High pressure liquid chromatography showed the presence of 3 isomers totalling 98.4%.

Calculated For: $C_{44}H_{46}N_6O_8$: C, 67.16; H, 5.89; N, 10.68. Found: C, 67.13; H, 5.91; N, 10.60.

SYNTHESIS EXAMPLE B

Inventive Compound I-28

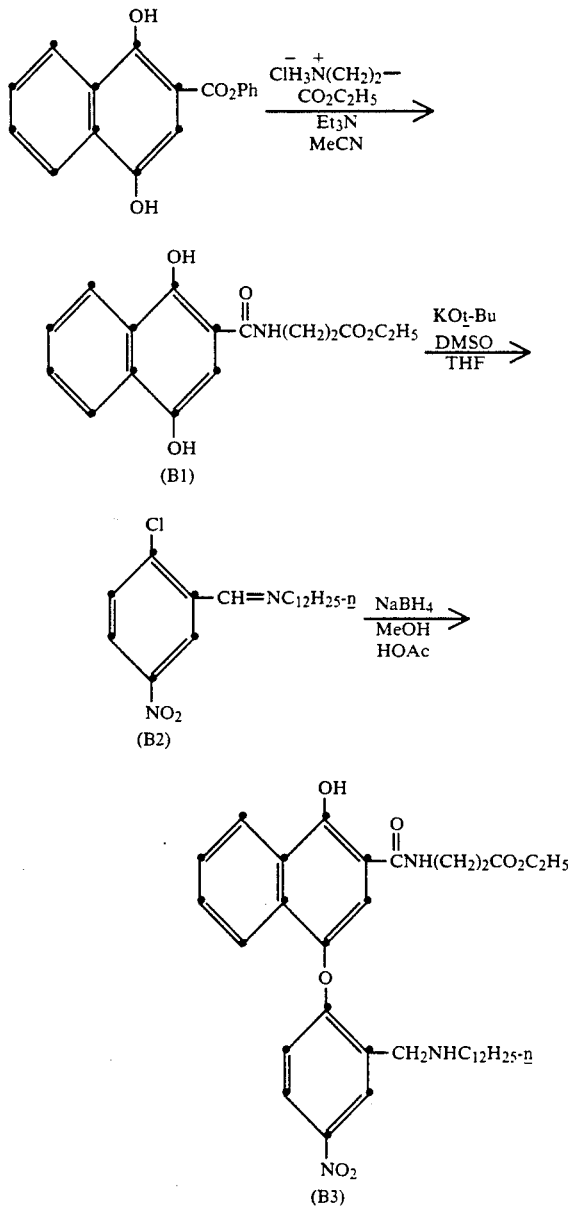

-continued

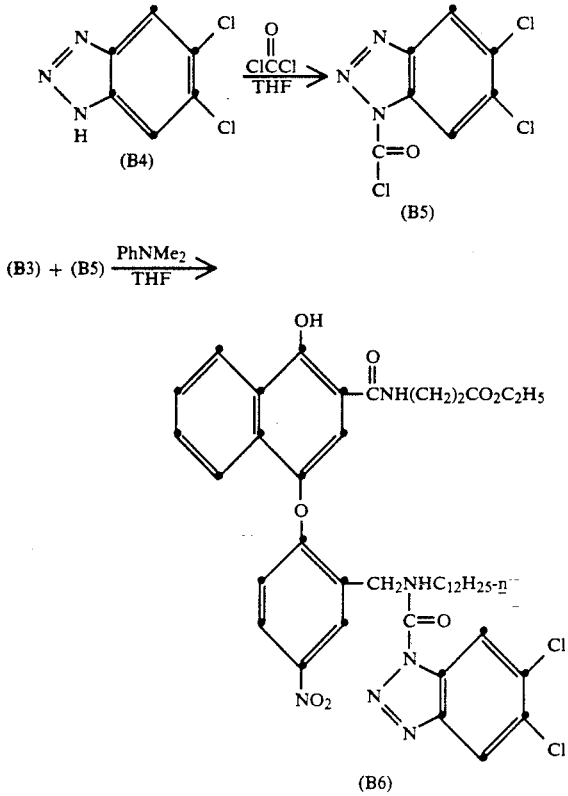

Et herein is ethyl.
Me herein is methyl.
THF herein is tetrahydrofuran.
HOAc herein is acetic acid.
Ph herein is phenyl.

Compound (B1)

Phenyl 1,4-dihydroxy-2-naphthoate (28.0 g, 0.10 mol) and β-analine ethyl ester hydrochloride (30.7 g, 0.20 mol) were mixed with acetonitrile (125 mL). The mixture was stirred at room temperature under a nitrogen atmosphere. A solution of triethylamine (20.2 g, 0.20 mol) in acetonitrile (60 mL) was added dropwise. After the addition was complete the mixture was heated to reflux for 2 hours. The mixture was allowed to cool to room temperature, then it was poured with stirring into a mixture of ice and water (1.0 L) and concentrated HCl (50 mL). The product came out of solution as a solid. The aqueous mixture was filtered and the collected solid was washed with water. The product was sucked as dry as possible on the funnel then was transferred to a beaker. The material was stirred with warm water (≈400 mL) for 10 minutes. The mixture was filtered and the solid was washed with cold water. The product was dried in a vacuum oven under a nitrogen atmosphere at ≈45° for 24 hours. This gave a pale tan powder, m.p. 162°-165°. Yield 29.4 g (97%).

Compound (B2)

2-Chloro-5-nitrobenzaldehyde (55.5 g, 0.30 mol) and n-dodecylamine (55.5 g, 0.30 mol) were mixed with ethanol (300 mL). The mixture was stirred and heated to reflux for 2 hours. The resulting warm solution was allowed to cool at room temperature; the product crystallized out. The mixture was chilled in ice, then was filtered. The collected solid was washed with cold methanol. The product was dried in a vacuum oven under a nitrogen atmosphere at room temperature overnight. This gave a beige colored powder, m.p. 52°-54°. Yield 88.7 g (84%).

Compound (B3)

Compound (B1) (24.2 g, 0.08 mol) and compound (B2) (28.2 g, 0.08 mol) were mixed with dry dimethylsulfoxide (DMSO) (300 mL) and dry tetrahydrofuran (60 mL). The mixture was stirred under a nitrogen atmosphere and was warmed to ≈35° with a hot water bath. All (B1) and (B2) went into solution. The heating bath was removed and the mixture was stirred at room temperature. Potassium t-butoxide (19.8 g, 0.176 mol) was added in portions over 15 minutes while keeping the pot temperature between 30°-35°. The resulting dark red solution was stirred for 2 hours at room temperature. Ethyl acetate (300 mL) and methanol (30 mL) were added to the mixture. The mixture was cooled to 0°-5° with an ice-salt bath. Sodium borohydride (4.0 g, 0.105 mol) was added in portions over 10 minutes. The mixture was stirred for 15 minutes, then the pH of the mixture was adjusted to ≈7 by adding acetic acid (10 mL). The mixture was stirred 2 hours at 0°-5°, then at room temperature overnight.

Water (100 mL) was added and the mixture was stirred ≈15 minutes. The reaction mixture was transferred to a separatory funnel. Ethyl acetate (≈300 mL) and water (≈300 mL) were added and the layers were allowed to separate. The organic layer was washed 3 times with water (≈200 mL portions) and once with saturated sodium chloride solution (≈250 mL). The ethyl acetate solution was dried over magnesium sulfate. This mixture was filtered through a pad of basic alumina. The solvent was removed from the filtrate on a rotary evaporator. The resulting reddish-brown oil was dissolved in ethanol (110 mL). This solution was stirred at room temperature overnight; a solid separated out. The mixture was chilled in ice, then was filtered. The collected solid was washed with cold ethanol, then with pentane. The product was dried in a vacuum oven at ≈40° under nitrogen for several hours. This gave compound (B3) a yellow powder, m.p. 101°-105°. Yield 21.8 g (44%).

Compound (B5)

Compound (B4) (14.0 g, 0.075 mol) was mixed with dry tetrahydrofuran (135 mL). The mixture was stirred at room temperature under a nitrogen atmosphere to form a slurry. Phosgene (18% solution in toluene, 98 mL, 0.098 mol) was added dropwise over 30 minutes. All (B4) dissolved as the addition proceeded. After the addition was complete the solution was stirred at room temperature for 17 hours. The solvent was removed on a rotary evaporator. The residue was dissolved in dichloromethane (≈200 mL). The solvent was again removed on a rotary evaporator. The remaining solid residue was slurried with pentane. The mixture was filtered and the product was dried in a vacuum oven at room temperature under a nitrogen atmosphere. This gave compound (B5) as a beige powder, m.p. 125°-128°. Yield 16.7 g (89%).

Compound (B6)

Compound (B3) (10.0 g, 0.016 mol) and N,N-dimethylaniline (9.7 g, 0.080 mol) were mixed with dry tetrahydrofuran (100 mL). The mixture was stirred at room temperature under a nitrogen atmosphere and a solution of compound (B5) (5.0 g, 0.020 mol) in tetrahydrofuran (75 mL) was added dropwise over 30 minutes. The resulting solution was stirred at room temperature for 1 hour. At this point TLC (silica gel-ethyl acetate/heptane; 30:70) showed a major product spot at Rf 0.55. The reaction mixture was poured with stirring into a mixture of ice and water (800 mL) plus hydrochloric acid (80 mL). The aqueous mixture was extracted 2 times with ethyl acetate. The extracts were combined and were washed 2 times with saturated sodium chloride solution. The extracts were dried over magnesium sulfate and then were filtered. The solvent was removed on a rotary evaporator to give a pale orange semi-solid. This material was dissolved in warm ethyl acetate (50 mL) and was chromatographed on a silica gel column (2.5 L) using ethyl acetate/heptane (25:75) as the eluant. The fractions containing the desired product were combined and the solvent was removed on a rotary evaporator. This gave a beige solid which was recrystallized from acetonitrile. The product was a beige powder, m.p. 133°-135°. Yield 8.8 g (66%). High pressure liquid chromatography showed the presence of one isomer (95.1%).

Calculated For: $C_{42}H_{48}Cl_2N_6O_8$: C, 60.35; H, 5.75; N, 10.05 Cl, 8.48. Found: C, 59.95; H, 5.54; N, 9.77; Cl, 8.19.

Another illustrative example of synthesis is shown below:

SYNTHESIS EXAMPLE C

Inventive Compound I-20

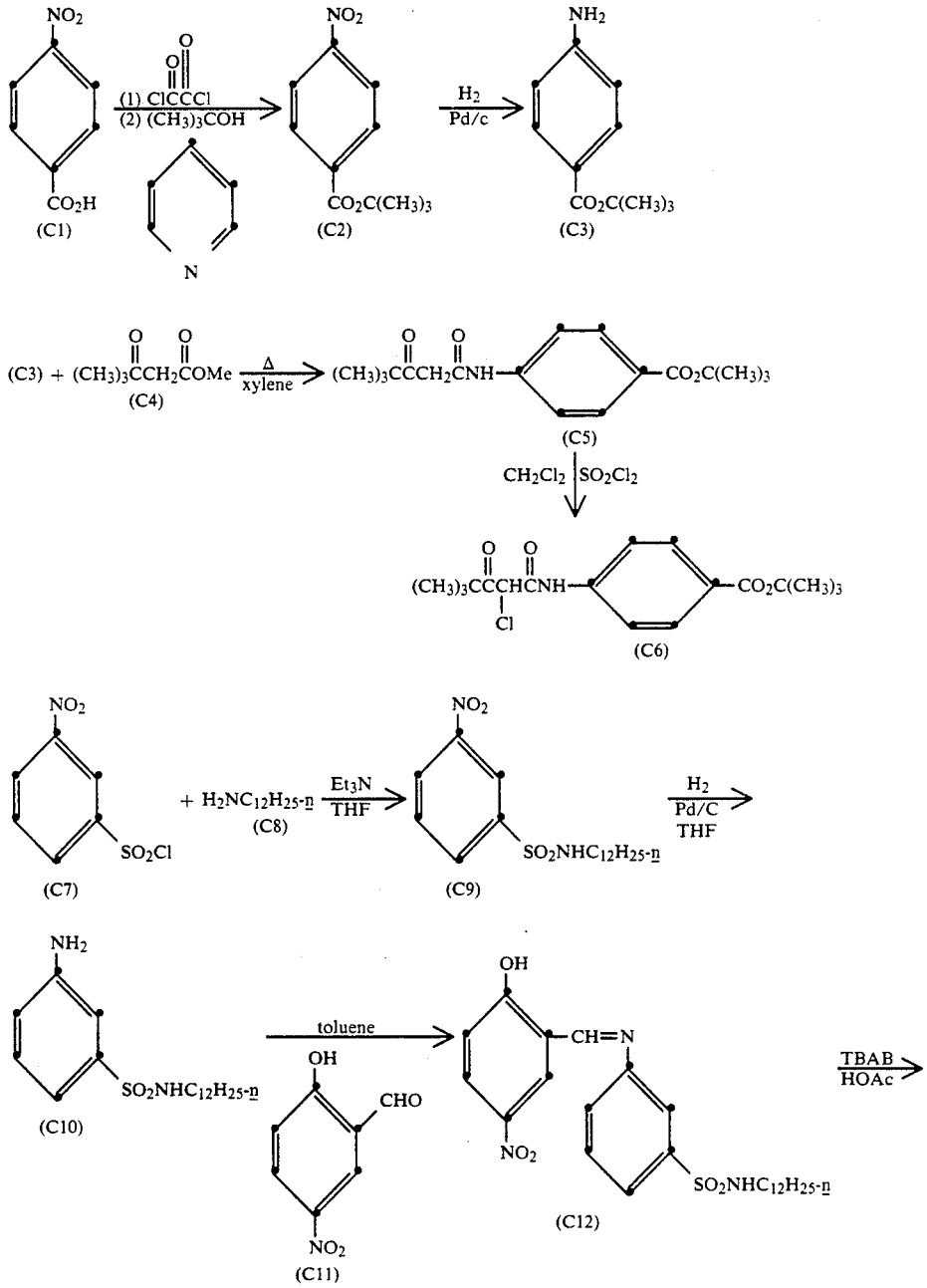

-continued

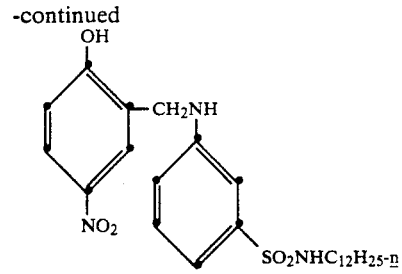

(C13)

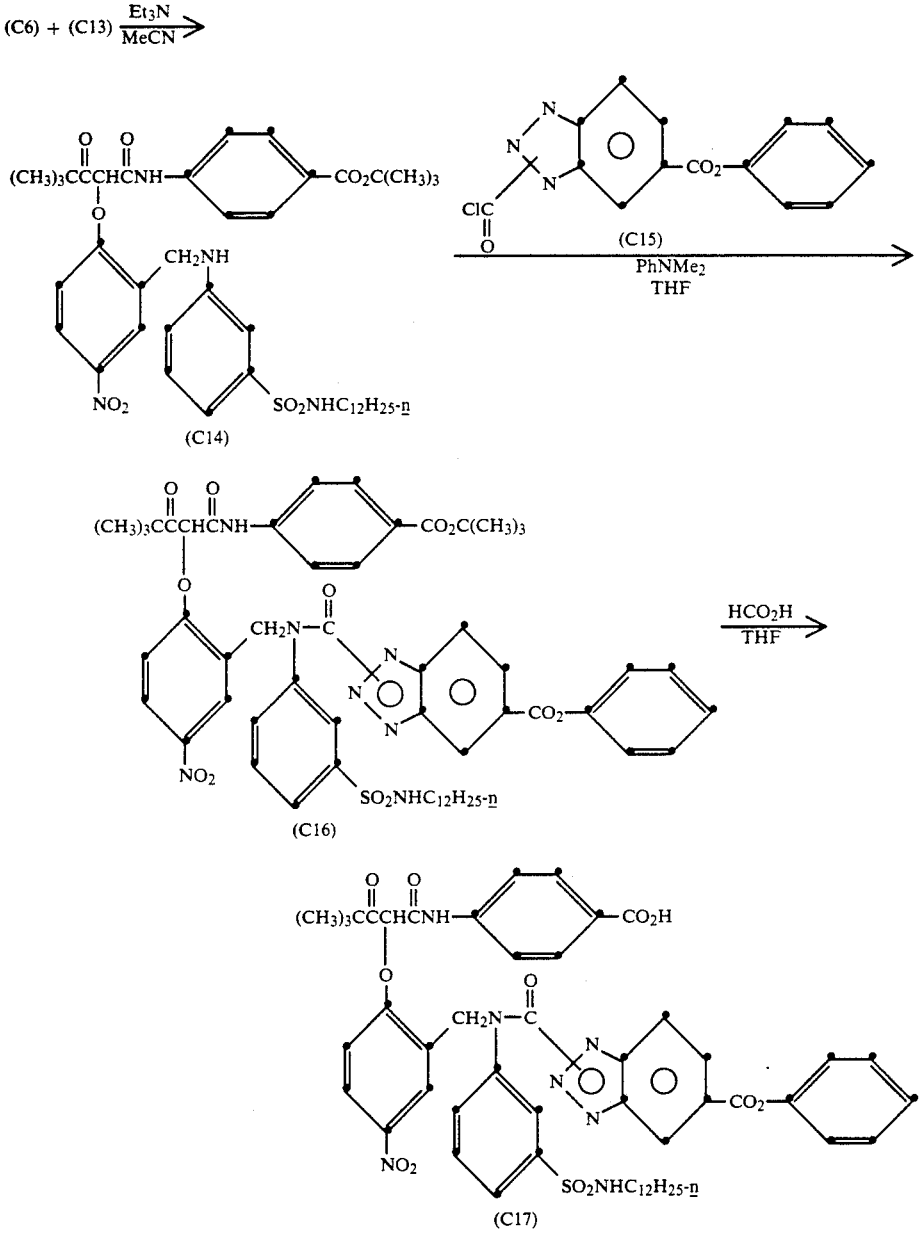

Compound (C14)

Compounds (C6) and (C13) were prepared by procedures as outlined above. Compound (C6) (5.4 g, 0.014 mol) and compound (C13) (7.5 g, 0.15 mol) were slurried in acetonitrile (100 mL). Triethylamine 4.5 g, 0.045 mol) was added dropwise. The resulting solution was stirred overnight at room temperature. The reaction mixture was poured into cold dilute hydrochloric acid. The aqueous mixture was extracted with ethyl acetate. The extracts were dried over magnesium sulfate and then were filtered. The solvent was removed on a rotary evaporator. The resulting yellow oil was chromatographed on silica gel using dichloromethane first as an eluant and then dichloromethane/ether (95:5) as an eluant. This gave compound (C14) as a yellow foam. Yield 5.6 g (46%).

Compound (C16)

Compound (C14) (13.4 g, 0.017 mol) and compound (C15) (5.1 g, 0.017 mol) were stirred in dry tetrahydrofuran (100 mL). N,N-dimethylaniline (10.3 g, 0.085 mol) was added. The resulting mixture was stirred overnight at room temperature. The reaction mixture was poured into cold dilute hydrochloric acid. The aqueous mixture was extracted with ethyl acetate. The extracts were dried over magnesium sulfate and then were filtered. The solvent was removed on a rotary evaporator. The residue was chromatographed on a silica gel column using dichloromethane/ether (100:0) to (95:5) as the eluant. The fractions containing the major product were combined and the solvent was removed in vacuo. This gave a yellow-orange foam. Yield 5.4 g (29%).

Compound (C17)

Compound (C16) (5.4 g, 0.0051 mol) was dissolved in tetrahydrofuran (5 mL) and formic acid (60 mL). This solution was stirred overnight at room temperature. During this time a solid slowly came out of solution. The mixture was filtered and the solid was washed with ethanol. This solid was slurried in dichloromethane and was chromatographed on silica gel using dichloromethane/ethyl acetate (70:30) as the eluant. The product fractions were combined and were concentrated to give a yellow foam. This foam was dissolved in ethanol and the solution was stirred at room temperature. A white solid precipitated out. This solid was filtered off and dried. Yield 2.0 g (38%). High pressure liquid chromatography showed the presence of 3 isomers totaling 99.8%.

Calculated For: $C_{53}H_{59}N_7O_{12}S+1H_2O$: C, 61.39; H, 5.89; N, 9.46 S, 3.09. Found: C, 61.27; H, 6.09; N, 8.71; S, 3.82.

SYNTHESIS EXAMPLE D

Inventive Compound I-41

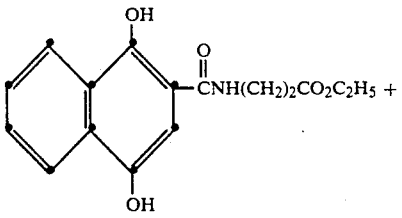

(D1)

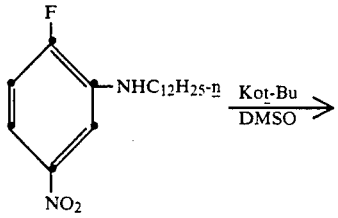

(D2)

-continued

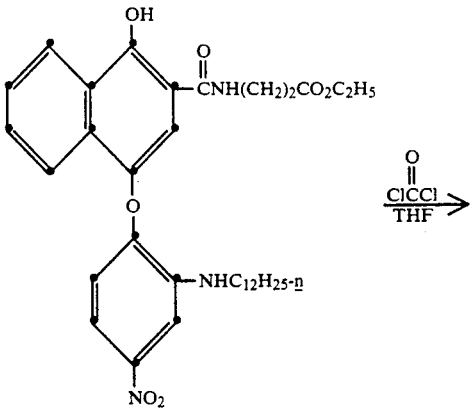

(D3)

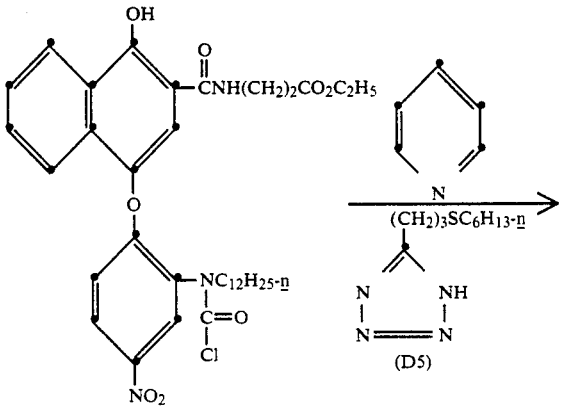

(D4) (D5)

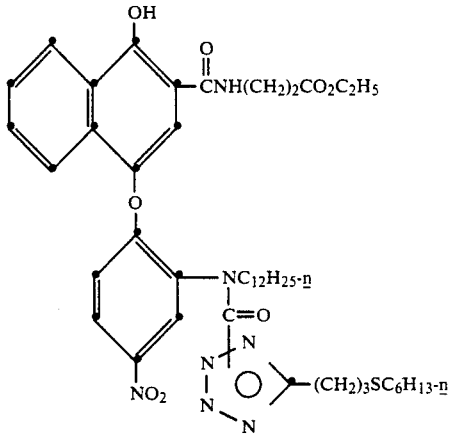

(D6)

Compound (D1)

Preparation already given as compound (B1) in Synthesis Example B.

Compound (D2)

2-Fluoro-5-nitroaniline (55.0 g, 0.35 mol) and lauroyl chloride (87.4 g, 0.40 mol) were mixed with tetrahydrofuran (450 mL). The mixture was stirred at room temperature under a nitrogen atmosphere. A solution of triethylamine (40.4 g, 0.40 mol) in tetrahydrofuran was added dropwise over 1 hour. After the addition was complete, the mixture was stirred for 1 hour at room temperature. The reaction mixture was poured with stirring into a mixture of ice and water (2 L) plus concentrated hydrochloric acid (200 mL). The aqueous mixture was filtered and the collected solid was washed with water. The crude product was dried and then was recrystallized from P-513 ligroin (~1 L). This gave 108.7 g (92%) of 2-fluoro-5-nitro-1-undecylcarbonylaminobenzene, m.p. 75°-77°.

2-Fluoro-5-nitro-1-undecylcarbonylaminobenzene (36.7 g, 0.11 mol) and tetrahydrofuran (400 mL) were mixed together. The mixture was chilled to ~5° in an ice-salt bath while kept under a nitrogen atmosphere. Sodium borohydride (16.5 g, 0.44 mol) was added in portions. When gas evolution ceased, acetic acid (25 mL, 26.4 g, 0.44 mol) was added slowly dropwise over ≈30 minutes. The mixture foamed vigorously and the rate of addition was adjusted to control the extent of foaming. After the addition was complete, the ice bath was removed and the mixture was stirred at room temperature for 15 minutes. The mixture was then slowly heated to reflux on a steam bath. After the vigorous foaming had subsided, the mixture was heated to reflux (pot temperature 65°-70°) for 3 hours. The mixture was allowed to cool to room temperature. It was then poured slowly with stirring into a cold mixture of ice and water (1 L) plus concentrated hydrochloric acid (150 mL). Vigorous foaming occurred as excess sodium borohydride was destroyed. The aqueous mixture was extracted 3 times with ethyl acetate. The extracts were combined and were washed 3 times with saturated sodium chloride solution. The extracts were dried over magnesium sulfate. Norit was added and the mixture was filtered. The solvent was removed on a rotary evaporator until ~70 mL solution remained. This solution was placed on a silica gel column (2.5 L). The column was eluted with ethyl acetate/heptane (6:94). The fractions containing the desired product were combined and the solvent was removed on a rotary evaporator. This gave a yellow oil which was dissolved in warm P950 ligroin (100 mL). The resulting solution was chilled in an ice-acetone bath. The product crystallized out. The mixture was filtered and the product was dried in a vacuum over at room temperature under nitrogen. This gave compound (D2) as a yellow powder, m.p. 44°-46°. Yield 22.6 g (63%).

Compound (D3)

Compound (D1) (19.7 g, 0.065 mol) and compound (D2) (21.1 g, 0.065 mol) were mixed with dry dimethyl sulfoxide (200 mL). The mixture was stirred at room temperature under a nitrogen atmosphere. Potassium t-butoxide (15.6 g, 0.14 mol) was added in portions over 10 minutes. After the addition was complete, the mixture was stirred at room temperature for 2 hours. At this point TLC (silica gel-ethyl acetate/heptane; 25:75) showed a major product spot at Rf 0.45. The reaction mixture was poured with stirring into a mixture of ice and water (1 L) plus concentrated hydrochloric acid (80 mL). The aqueous mixture was extracted 3 times with ethyl acetate. The extracts were combined and were washed 3 times with saturated sodium chloride solution. The extracts were treated with Norit and were dried over magnesium sulfate. The mixture was filtered and the solvent was removed on a rotary evaporator to give a dark oil. This oil was dissolved in warm ethyl acetate (50 mL) and this solution was placed on a silica gel column (2.5 L). The column was eluted with ethyl acetate/heptane (20:80). The fractions containing the desired product were combined and the solvent was removed on a rotary evaporator. The resulting solid was slurried with pentane and this mixture was filtered. The product was dried to give compound (D3) as a yellow solid, m.p. 84°-87°. Yield 16.5 g (42%).

Compound (D4)

Compound (D3) (6.1 g, 0.01 mol) was dissolved in dry tetrahydrofuran (50 mL). This solution was stirred at room temperature under a nitrogen atmosphere. Phosgene (16% solution in toluene, 30 mL, 0.03 mol) was added dropwise over 15 minutes. After the addition was complete the mixture was stirred at room temperature for 16 hours. The solvent was removed from the reaction solution on a rotary evaporator to give an oil which was used immediately without further purification. Thin layer chromatography (TLC) (silica gel-ethyl acetate/heptane; 25:75) showed a major spot at Rf 0.40.

Compound (D6)

Compound (D4) (0.01 mol) from above was dissolved in dry pyridine (40 mL). This solution was added to a mixture of (D5) (2.3 g, 0.01 mol) in dry pyridine (30 mL) at room temperature under a nitrogen atmosphere. After the addition was complete the mixture was stirred for 4 ½ hours at room temperature. At this point TLC (silica gel-ethyl acetate/heptane; 30:70) showed a major product spot at Rf 0.50. The reaction mixture was poured with stirring into a cold mixture of ice and water (800 mL) plus concentrated hydrochloric acid (80 mL). The aqueous mixture was extracted 3 times with ethyl acetate. The extracts were combined and were washed twice with saturated sodium chloride solution. The extracts were dried over magnesium sulfate and were treated with Norit. The mixture was filtered and the solution was concentrated to give a brown oil. This oil was dissolved in ethyl acetate (40 ml) and was chromatographed on a silica gel column (2.0 L) using ethyl acetate/heptane (25:75) as an eluant. The fractions containing the desired product were combined and the solvent was removed on a rotary evaporator. This gave a tan oil (3.6 g) which was stirred with ethanol (10 mL) at room temperature overnight. The product crystallized under these conditions. This mixture was filtered and the collected solid was washed with fresh cold ethanol. The product was dried in a vacuum oven at room temperature to give compound (D6) as a yellow solid, m.p. 72°-75° . Yield 1.4 g (16%). High pressure liquid chromatography showed presence of 2 isomers totalling 90.4%.

Calculated For: $C_{45}H_{63}N_7O_8S$: C,62.70; H,7.37; N,11.37; S,3.72. Found: C,62.84; H,7.22; N,10.75; S,3.13.

Examples of couplers that can be prepared are as follows:

I-1
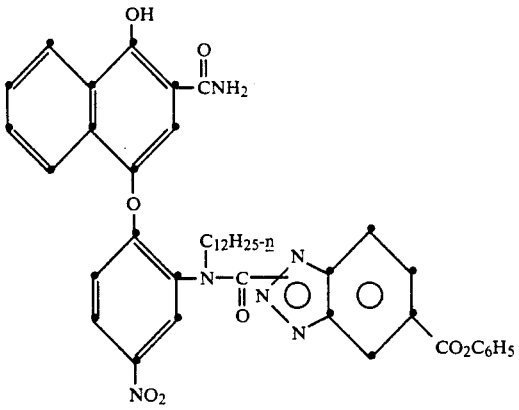
I-2
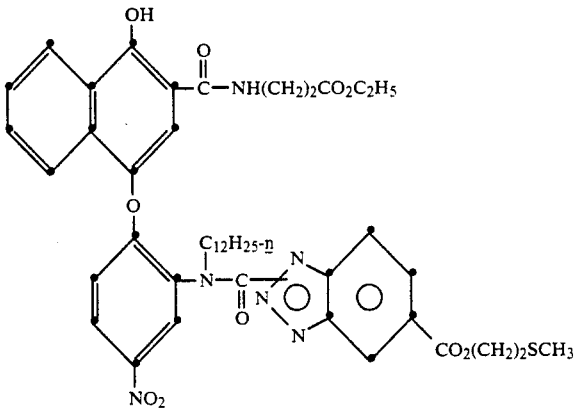
I-3
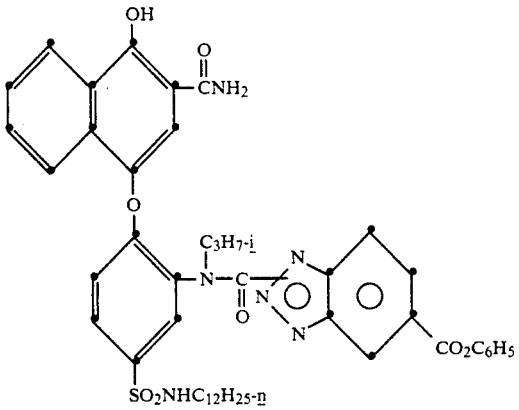
I-4
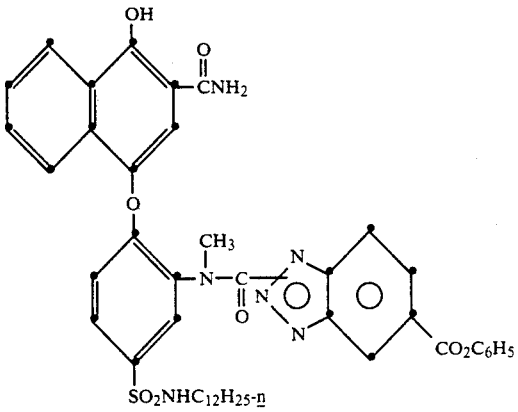

-continued
I-5
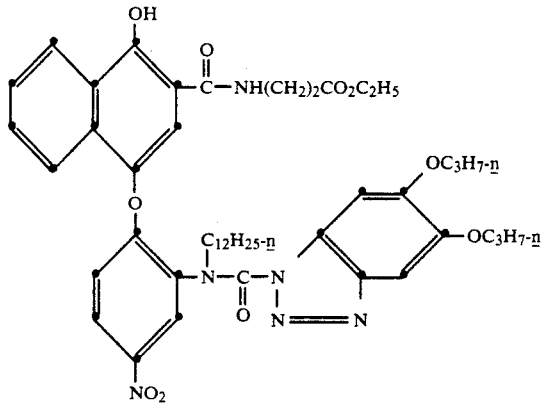
I-6
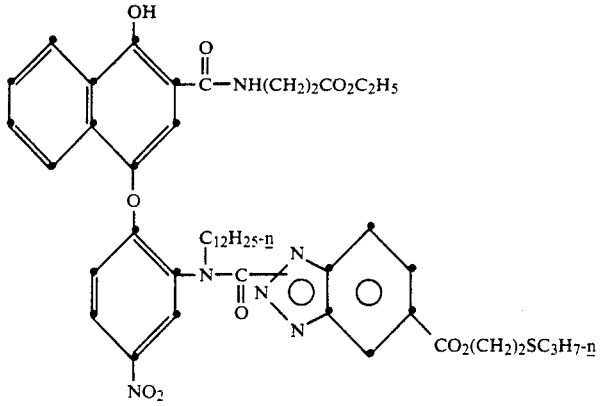
I-7
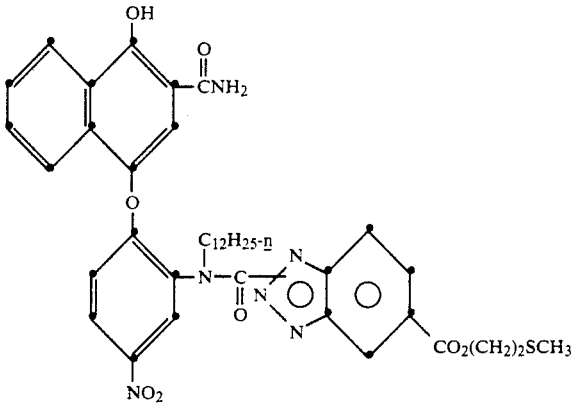
I-8
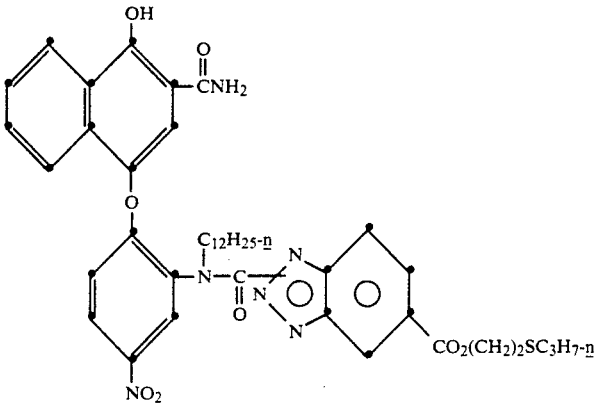

-continued
I-9
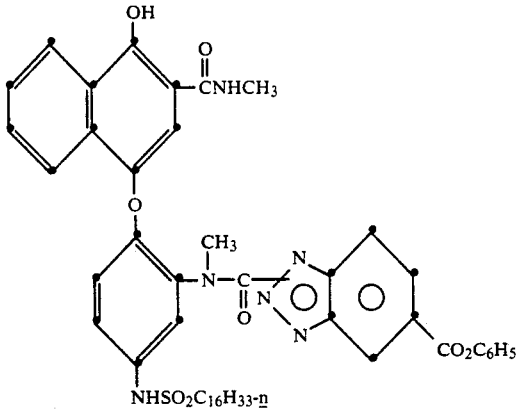
I-10
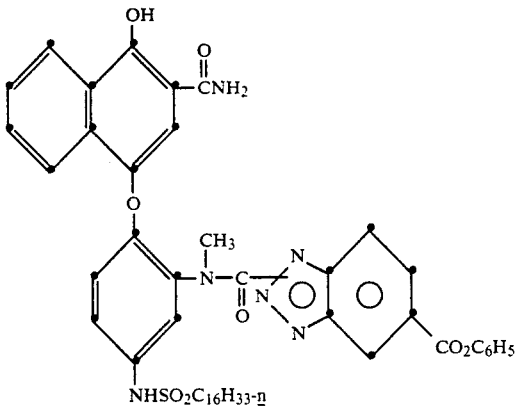
I-11
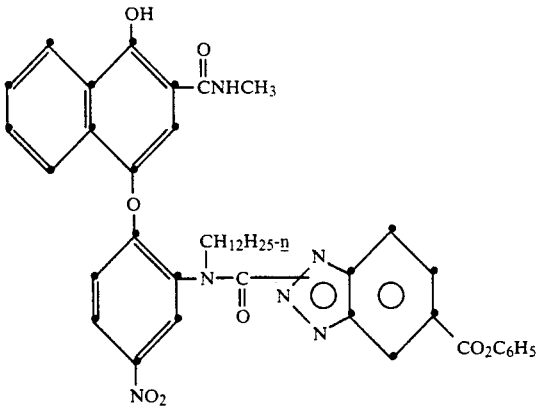
I-12
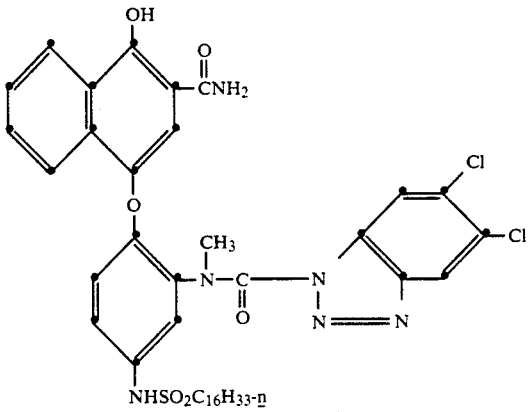

-continued
I-13
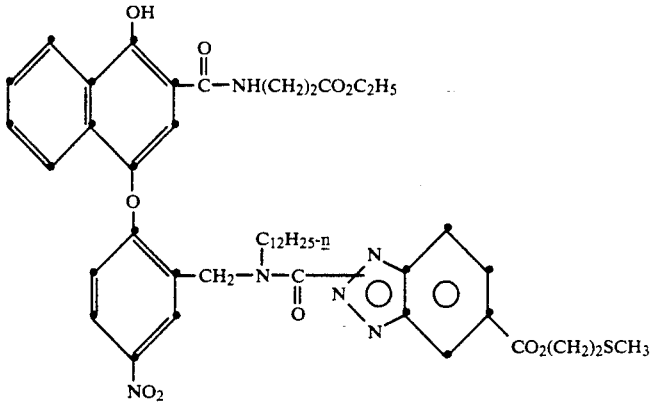
I-14
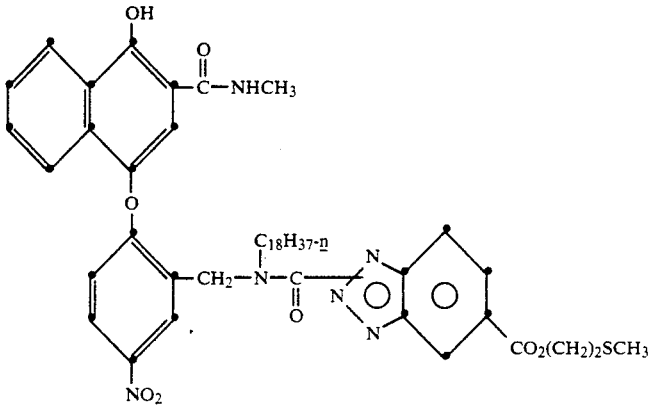
I-15
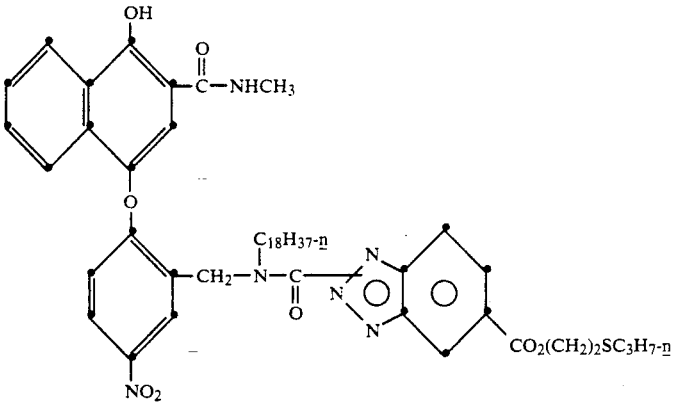
I-16
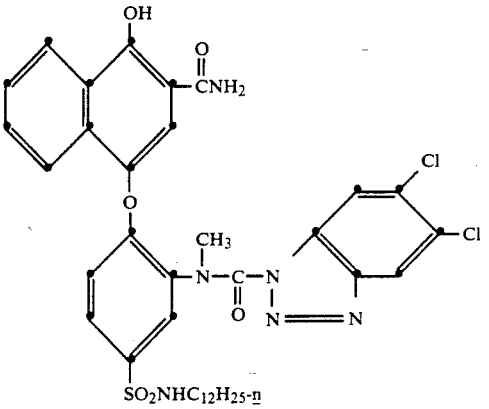

-continued
I-17
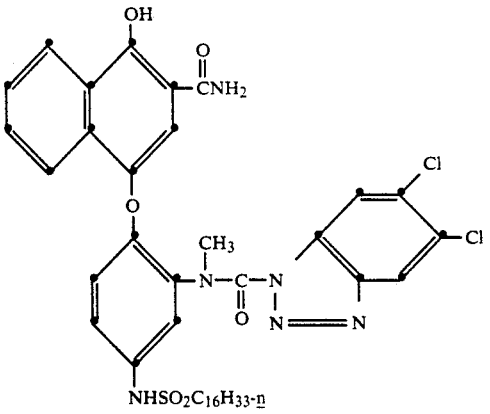
I-18
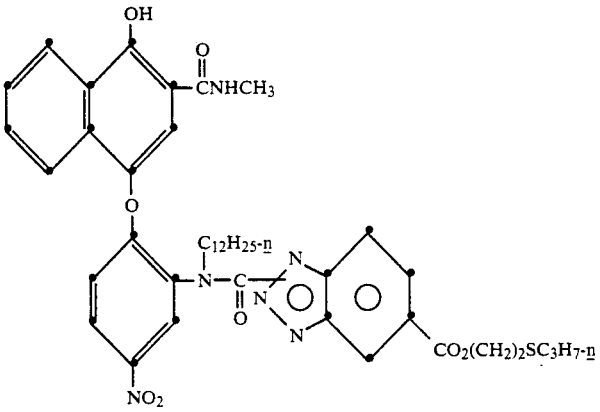
I-19
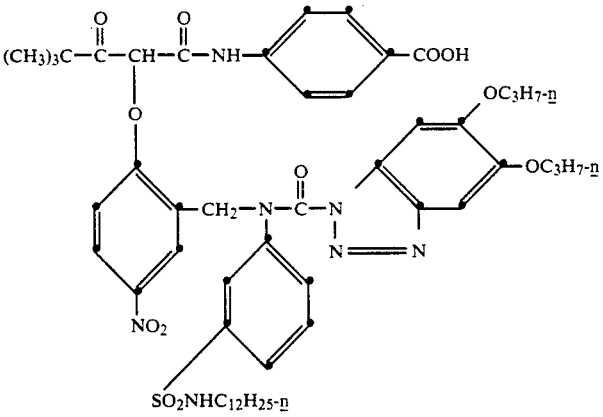
I-20
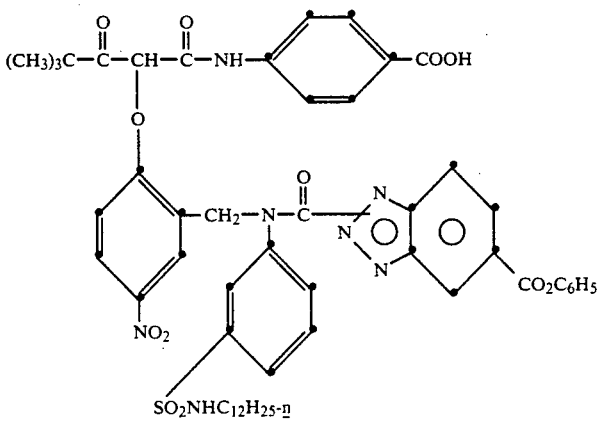

-continued
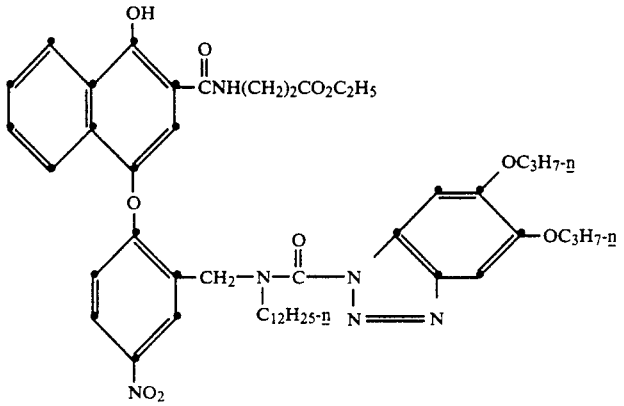
I-21
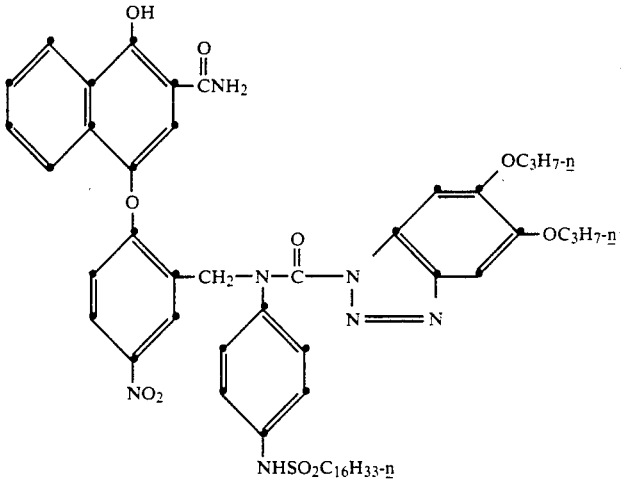
I-22
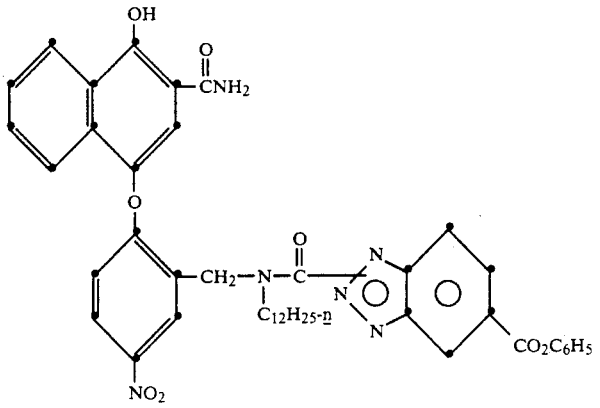
I-23

-continued
I-24
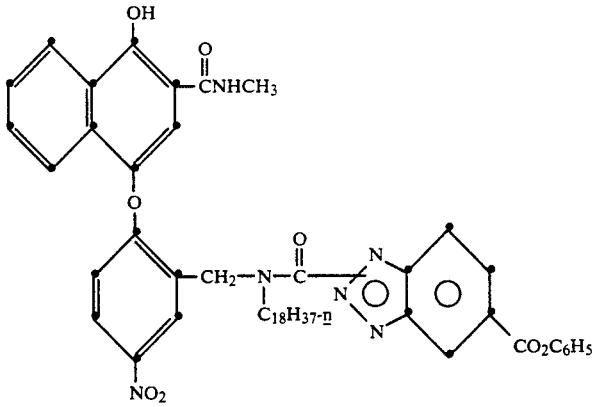
I-25
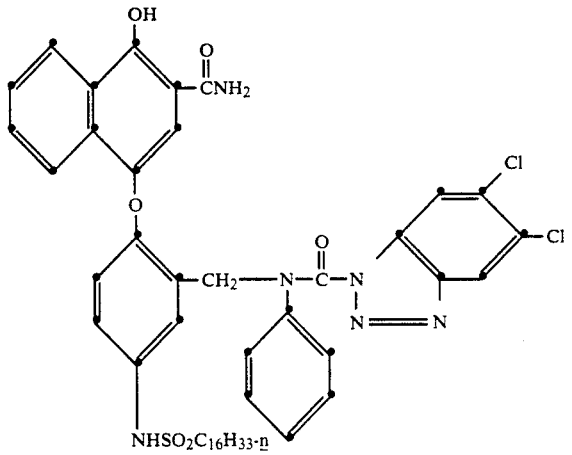
I-26
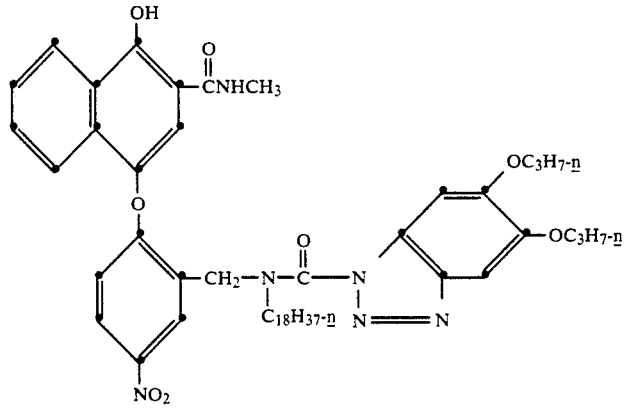
I-27
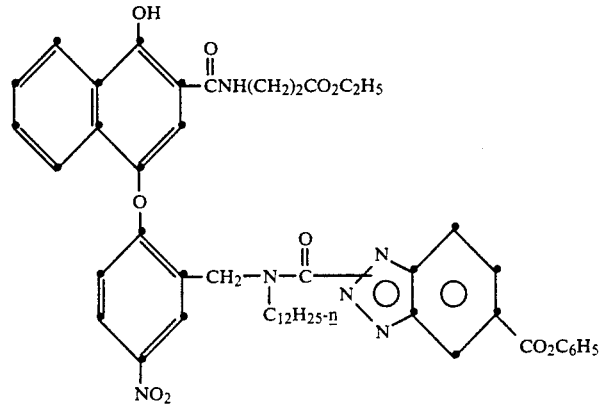

-continued
I-28
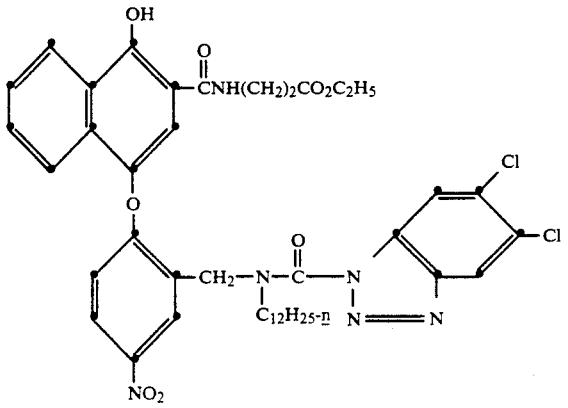
I-29
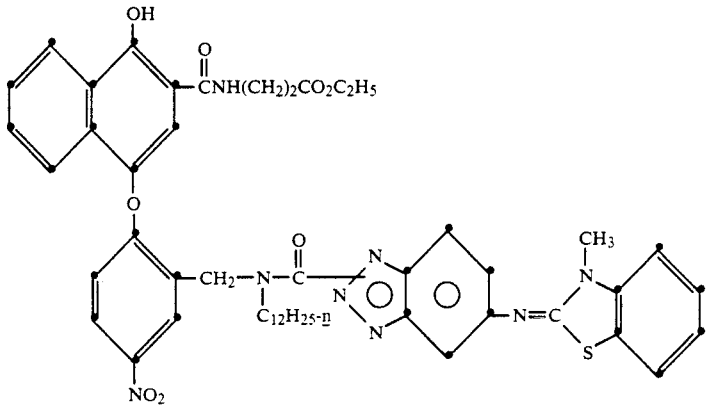
I-30
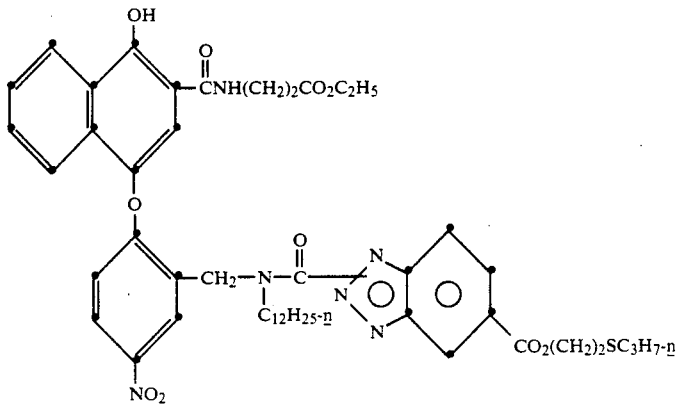

-continued
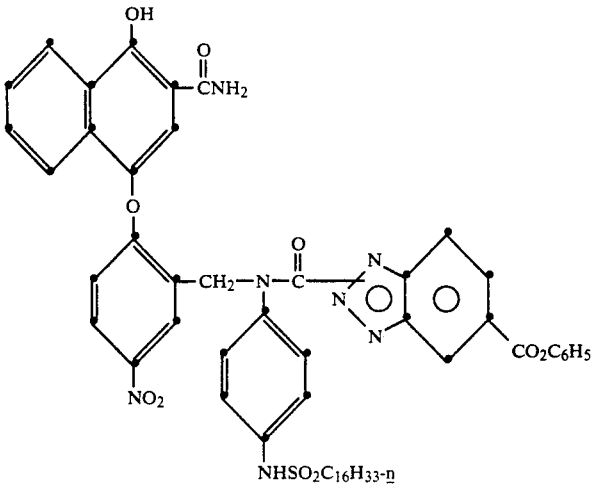
I-31
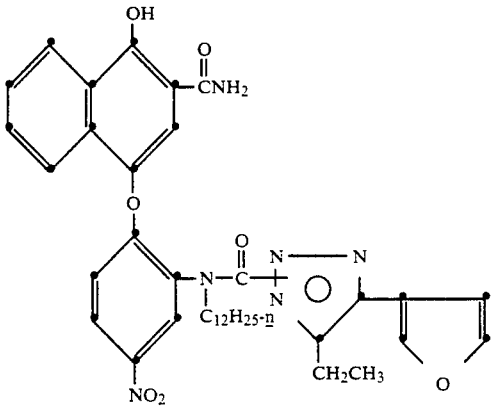
I-32
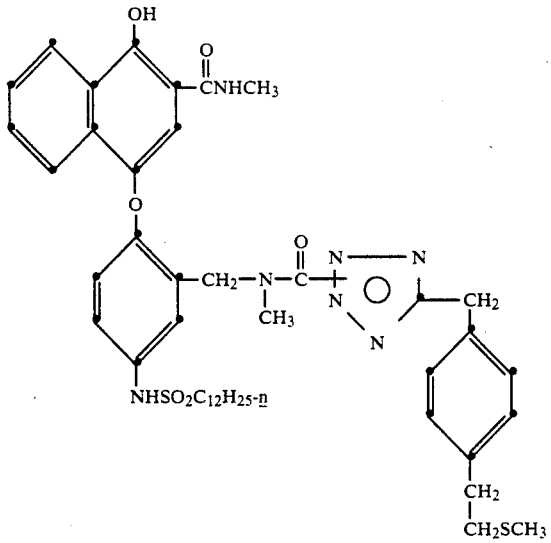
I-33

-continued
I-34
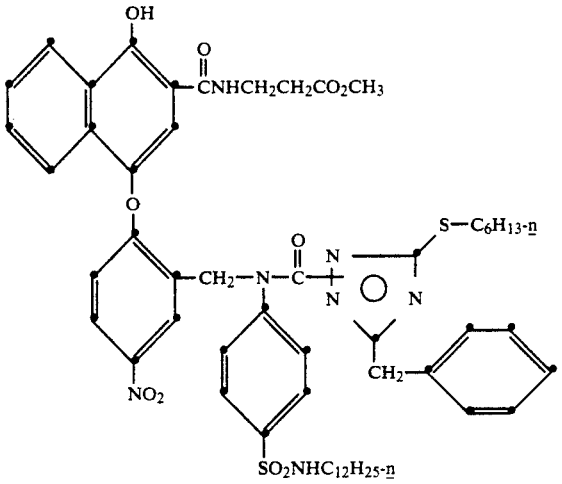
I-35
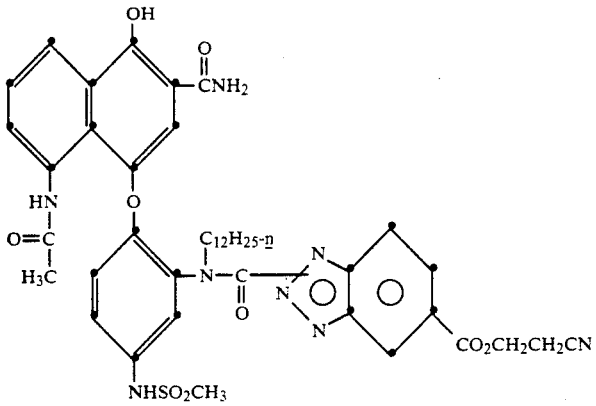
I-36
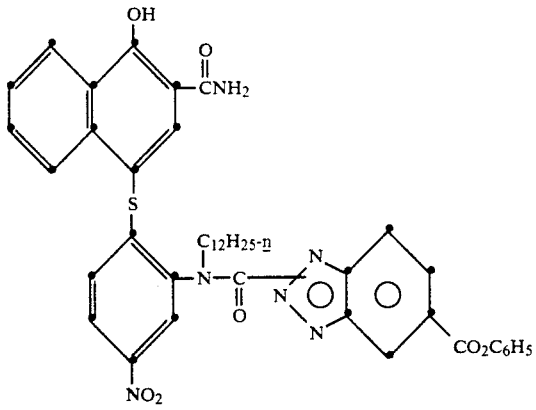
I-37
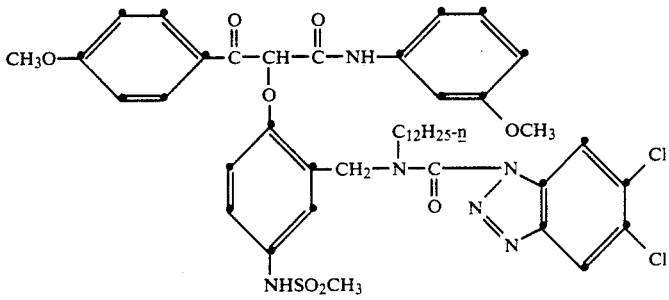

-continued
I-38
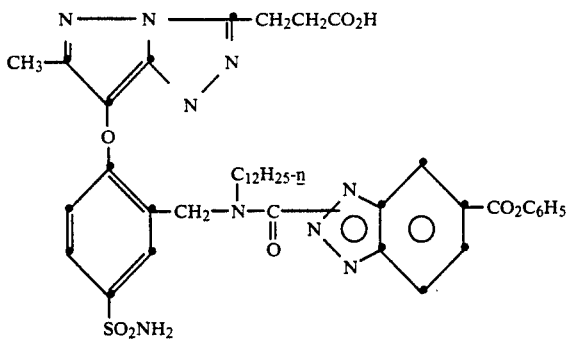
I-39
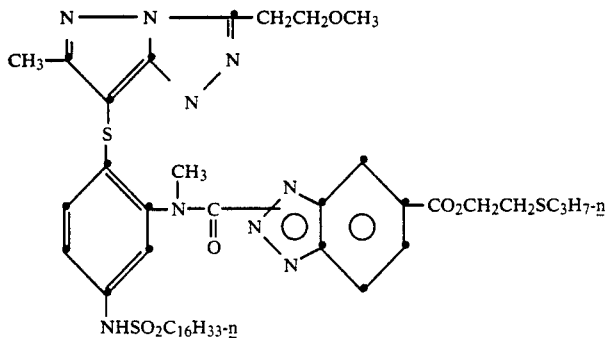
I-40
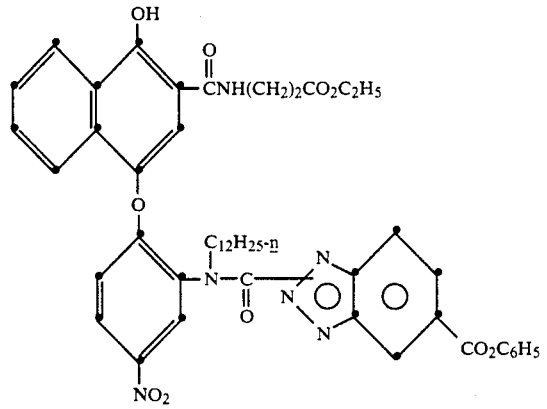
I-41
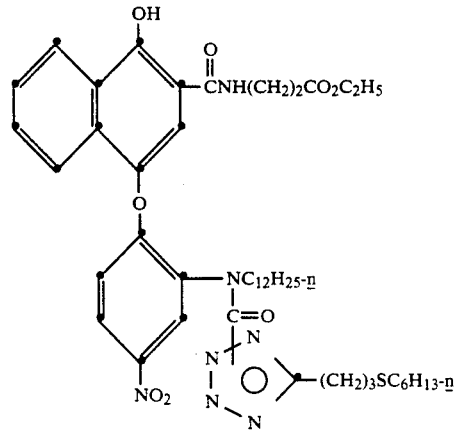

-continued

I-42

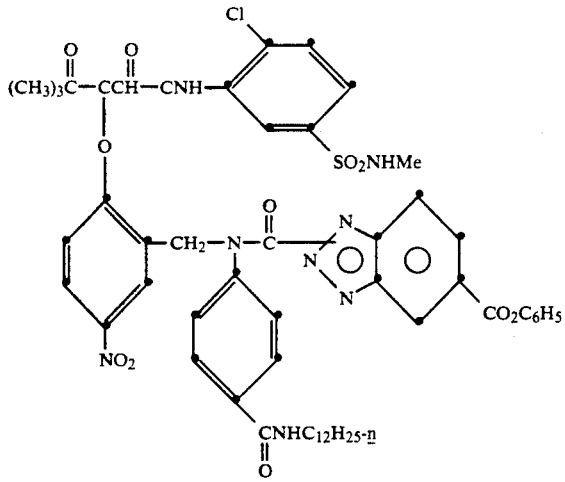

I-43

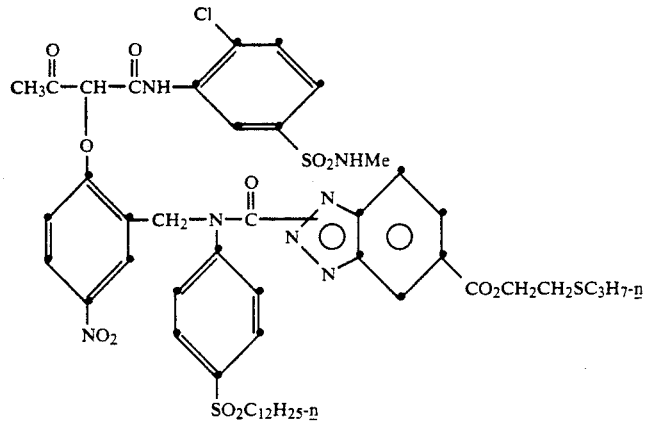

It is understood that the synthetic procedures generally result in a mixture of isomers. The photographic properties of the mixtures are generally indistinguishable from those of the individual isomers. In some cases individual isomers were obtained.

The following examples further illustrate the invention.

EXAMPLES 1-2

A color photographic recording material (comparative sample A) for color negative development was prepared by applying the following layers in the given sequence to a transparent cellulose triacetate film support. The quantities of silver halide are given in mg of silver per $ft^2$. The quantities in "( )" are in mg per $m^2$. All silver halide emulsions were stabilized with 2 grams of 4-hydroxy-6-methyl-1,3,3a,7-tetraazaindene per mole of silver.

Layer 1 (Antihalation Layer):

Black colloidal silver sol containing 22 mg (236) of silver and 227 mg (2440) gelatin.

Layer 2 (First Red-Sensitive Layer):

Red sensitized silver iodobromide emulsion (3.0 mol percent iodide, average grain diameter 0.6 microns) at 50 mg (538), red sensitized silver iodobromide emulsion (4.5 mol percent iodide, average grain diameter 1.2 microns) at 80 mg (860), cyan dye-forming image coupler C-1 at 100 mg (1075), DIR compound D-1 at 3 mg (32) with gelatin at 300 mg (3225).

Layer 3 (Second Red-Sensitive Layer):

Red sensitized silver iodobromide emulsion (4.0 mol percent iodide, average grain diameter 2.3 microns) at 150 mg (1612), cyan dye-forming image coupler C-1 at 35 mg (376), DIR compound D-1 at 3.8 mg (41) with gelatin at 250 mg (2688).

Layer 4 (Interlayer):

Oxidized developer scavenger S-1 at 5 mg (54), with 100 mg (1075) gelatin.

Layer 5 (First Green-Sensitive Layer):

Green sensitized silver iodobromide emulsion (3.3 mol percent iodide, average grain diameter 0.58 microns) at 30 mg (322), green sensitized iodobromide emulsion (2.0 mol percent iodide, average grain diameter 1.1 microns) at 75 mg (806), magenta dye-forming image coupler M-1 at 50 mg (538), DIR compound D-2 at 2.5 mg (27) with gelatin at 230 mg (2473).

Layer 6 (Second Green-Sensitive Layer):

Green sensitized silver iodobromide emulsion (2 mol percent iodide, average grain diameter 1.48 microns) at 115 mg (1236), magenta dye-forming image coupler M-2 at 18 mg (194), DIR compound D-2 at 1.3 mg (14) with gelatin at 230 mg (2473).

Layer 7 (Interlayer):

Oxidized developer scavenger S-1 at 5 mg (54), yellow colloidal silver at 6 mg (65) with gelatin at 100 mg (1075).

Layer 8 (First Blue-Sensitive Layer):

Blue sensitized silver iodobromide emulsion (1.1 mol percent iodide, average grain diameter 0.60 microns) at 25 mg (269), blue sensitized silver iodobromide emulsion (2.4 mol percent iodide, average grain diameter 2.15 microns) at 40 mg (430), yellow dye-forming image coupler Y-1 at 75 mg (806), DIR compound D-3 at 3 mg (33) with gelatin at 150 mg (1612).

Layer 9 (Second Blue-Sensitive Layer):

Blue sensitized silver iodobromide emulsion (12 mol percent iodide, average grain diameter 2.01 microns) at 75 mg (806), yellow dye-forming image coupler Y-1 at 12 mg (129) with gelatin at 150 mg (1612).

Layer 10 (Protective Layer):

110 mg (1183) of gelatin with 2% by weight to total gelatin of hardener H-1.

Compounds M-1, M-2 and D-2 were used as emulsions containing tricresylphosphate; compounds C-1, Y-1 and D-3 were used as emulsions containing di-n-butyl phthalate; while compound D-1 was used as an emulsion containing N-n-butyl acetanilide.

Photographic comparative sample A incorporates a magenta dye-forming DIR compound (D-2) known in the art (from U.S. Pat. No. 3,615,506).

Additional photographic samples were prepared in an analogous manner except that various DIR compounds were substituted for DIR D-2 in the fast magenta layer (second green-sensitive layer #6) and in the slow magenta layer (first green-sensitive layer #5) as indicated in Table 1. The quantities of the various DIR compounds were selected to provide a green dye gamma of approximately 0.65 after a white light exposure and color processing as described below.

Photographic comparative sample B incorporates a cyan dye-forming DIR compound (D-4) known in the art (from U.S. Pat. No. 4,248,962).

Photographic examples 1 and 2 incorporate DIR compounds of the invention.

These samples were exposed either to white light, red light (using a Kodak Wratten 29 filter) or green light (using a Kodak Wratten 74 filter) through a grey wedge chart. These samples were then developed using a color negative process, the KODAK C-41 process, as described in the British Journal of Photography Annual of 1988, pp. 196–198. (Kodak and Wratten are trademarks of Eastman Kodak Company, U.S.A.).

Several performance features of these samples were evaluated:

The interlayer interimage effect in the red record (IIE cyan) was analyzed using the method described at col. 14, lines 25–35 of U.S. Pat. No. 4,840,880. The IIE cyan is defined as (the red density gradation on selective exposure to red light minus the red density gradation on selective exposure to white light) divided by the red density gradation on selective exposure to white light. In this case larger values of IIE cyan are preferred. The inventive compounds provide larger values of IIE cyan than to the comparative compounds.

The color turbidity associated with red density contamination of the green record was analyzed using the method described at example 2 and table 3 of Japanese published patent application (Kokai) 63-037350. In this case, the films were selectively exposed to green light before color development. The color turbidity is defined at 100 times the (red density formed at an exposure giving a green density of 1.0 minus the red density at fog) divided by the red density at fog. A purer color is demonstrated by a smaller value of color turbidity. Smaller values of color turbidity are preferred. The inventive compounds provide the smallest values of color turbidity.

The appearance of sharpness in the green record was evaluated at 35 mm system acutance. This method is described in col. 18, lines 8–14 of U.S. Pat. No. 4,782,012. Acutance is an objective correlate of sharpness. It is scaled such that a change of one acutance unit signifies a just-noticeable difference in sharpness. This definition appears at pages 957–960 of the SPSE Handbook of Photographic Science and Engineering (1973). The photographic examples 1 and 2 which incorporate the inventive compounds provide the largest improvement in green layer sharpness over the comparative samples A and B.

The stability of the compounds was monitored by storing film samples for four weeks at a temperature of 38° C. and at a relative humidity of 50%. The samples were then developed as described earlier and the increase in green fog density was monitored. All of the inventive compounds show excellent stability.

The formulas of the described couplers are as follows:

C-1

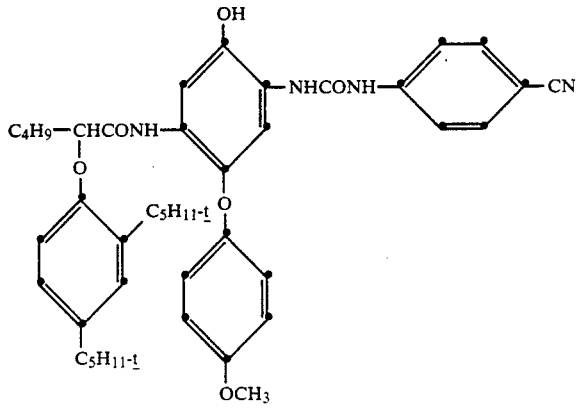

-continued
D-1
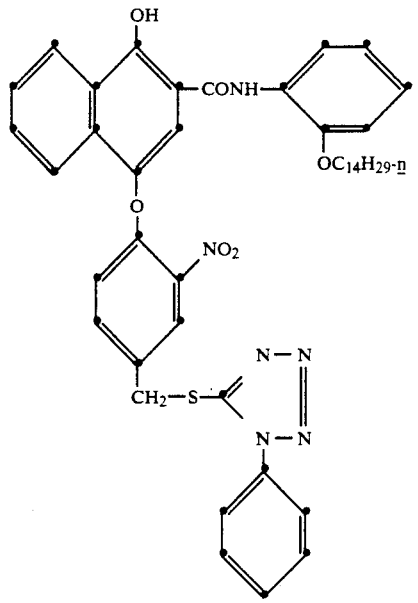
S-1
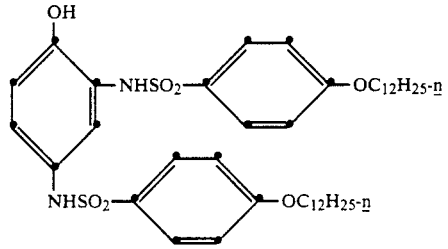
M-1
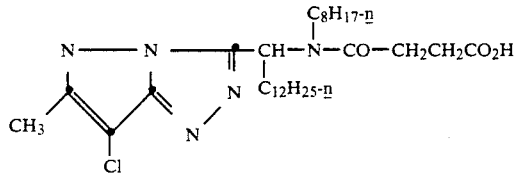
M-2
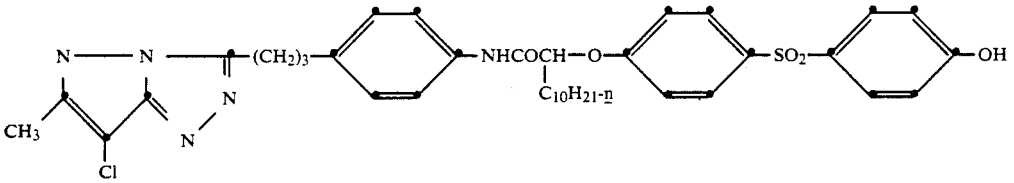
D-2
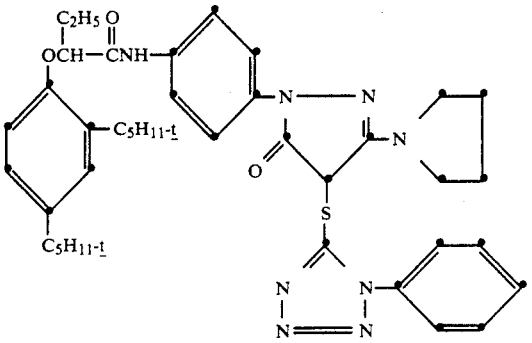

-continued
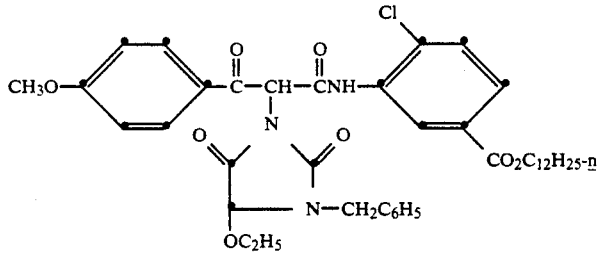
Y-1
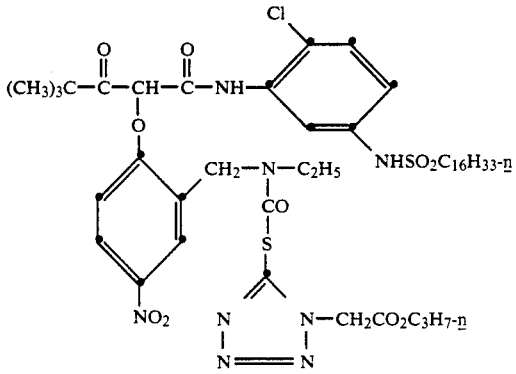
D-3
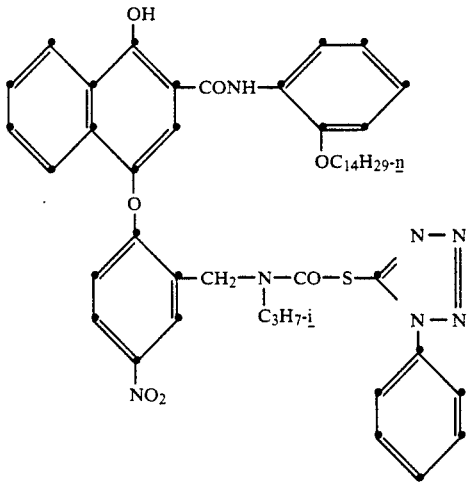
D-4
The following DIR couplers of the invention provided useful improved sharpness and stability in a color photographic element and processing as described:

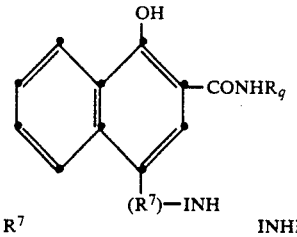

| DIR | $R_q$ | $R^7$ | INHIBITOR (INH) |
|---|---|---|---|
| I-27 | $-CH_2CH_2CO_2C_2H_5$ | 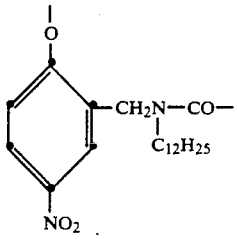 | 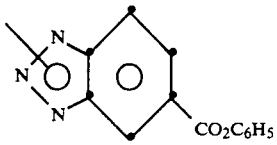 |
| I-11 | $-CH_3$ | 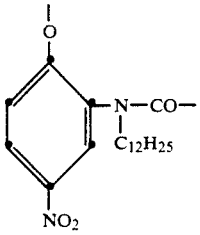 | 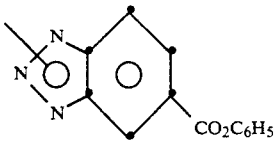 |

TABLE I

| | | (a) DIR COMPOUND IN FAST | IN SLOW | (b) IIE CYAN | (c) COLOR TURBIDITY % | (d) SHARPNESS | (e) STABILITY |
|---|---|---|---|---|---|---|---|
| A | (Control) | D-2 (14) | D-2 (27) | 0.19 | 18.2 | check | +0.04 |
| B | (Control) | D-4 (21) | D-4 (37) | 0.33 | 27.6 | +0.4 | +0.02 |
| | (Invention) | I-11 (64) | I-11 (106) | 0.44 | 4.1 | +1.1 | 0 |
| 2 | (Invention) | I-27 (58) | I-27 (96) | 0.59 | 4.1 | +0.9 | 0 |

(a) Quantity of DIR Compound in mg/m$^2$
(b) As defined at col. 14, lines 23-35 of U.S. Pat. No. 4,840,880
(c) Increase in red density over fog at a green density of 1.0 after a green light exposure as defined at example 2, Table 3 of Japanese Kokai 63-037350
(d) Increase in green sensitive element 35 mm system acutance over sample 1
(e) Increase in green fog after keeping for 4 weeks at 38° C., 50% R.H.

DIR compounds I-27 and I-11 of the invention provide stability that is improved compared to comparison DIR compounds D-2 and D-4 while enabling wash-out of the dye formed (see improved color turbidity) improving the sharpness of the image formed and increasing the interlayer interimage effect.

EXAMPLE 3

Improved stability can also be provided in a photographic element and process as described in Example 1 with substitution of the following coupler I-21 for control DIR compounds D-2 and D-3:

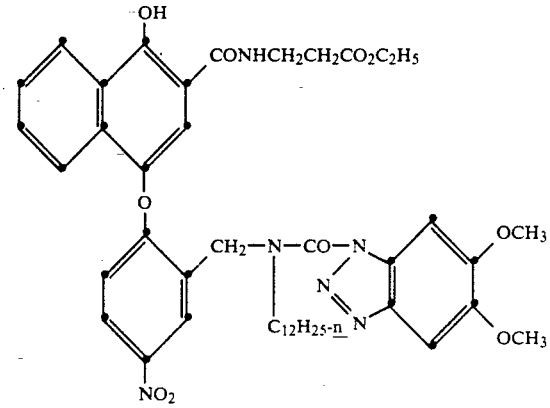

EXAMPLES 4–26

Photographic elements were prepared by coating the following layers on a cellulose ester film support (amounts of each component are indicated in mg/m$^2$):

Emulsion layer 1:
Gelatin-2691;
red sensitized silver bromoiodide (as Ag)-1615;
yellow dye-forming image coupler Y-2 dispersed in dibutyl phthalate (RECEIVER LAYER)
Interlayer:
Gelatin-624;
didodecylhydroquinone -113
Emulsion layer 2:
Gelatin;
green sensitized silver bromoiodide (as Ag)-1615;
magenta dye-forming image coupler M-3 dispersed in dibutyl phthalate;
DIR compound of Table II dispersed in N,N-diethyldodecanamide and coated at a level sufficient to provide a contrast to green light of 0.5 of the original contrast after stepwise green light exposure and processing. (CAUSER LAYER)
Protective Overcoat
Gelatin-5382;
bisvinylsulfonylmethyl ether at 2% total gelatin.

Structures of the image couplers are as follows:

Magenta Image Coupler M-3:

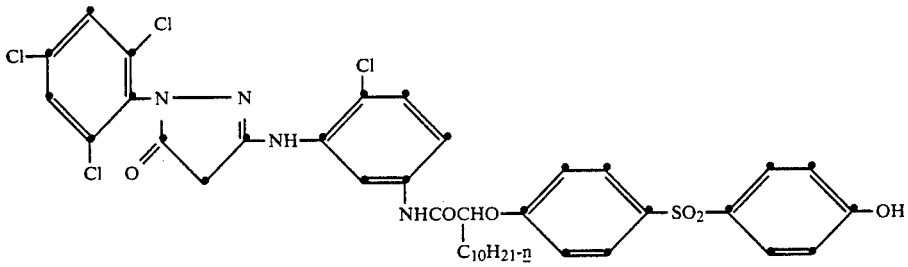

Yellow Image Coupler Y-2:

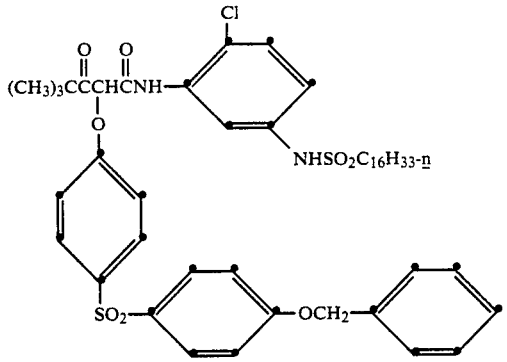

Strips of each element were exposed to green light through a graduated density step tablet, or through a 35% modulation fringe chart for sharpness measurements, and then developed 3.25 minutes at 38° C. in the following color developer, stopped, washed, bleached, fixed, washed and dried.

| Color Developer: | |
|---|---|
| Distilled water | 800 mL |
| Sulfuric acid | 2.0 mL |
| Potassium Sulfite | 2.0 g |
| CD-4 | 3.35 g |
| Potassium Carbonate | 30.0 g |
| Potassium Bromide | 1.25 g |
| Potassium Iodide | 0.6 mg |
| Distilled water | to 1 L |

Adjust pH to 10.0.

CD-4 is 4-amino-3-methyl-N-ethyl-N-beta-hydroxyethylaniline sulfate.

Processed images were read with green light to determine the contrast and AMT acutance. From plots of AMT acutance vs. the logarithm of the contrast for variations in the coated level of each development inhibitor releasing (DIR) compound, the acutance was determined at a contrast of 0.5 of its original contrast without the presence of the DIR compound. The acutance values are reported in following Table II. AMT calculations employed the following formula in which the cascaded area under the system modulation curve is shown in equation (21.104) on page 629 of the "Theory of the Photographic Process", 4th Edition, 1977, edited by T. H. James: AMT=100+66 Log [cascaded area/2.6696M] wherein the magnification factor M is 3.8 for the 35 mm system AMT. The use of CMT acutance is described by R. G. Gendron in "An Improved Objective Method of Rating Picture Sharpness: CMT actuance" in the Journal of SMPTE, Vol. 82, pages 1009–12, (1973). AMT is a further modification of CMT useful for evaluating systems which include the viewing of a positive print made from a negative.

Interlayer interimage effects were evaluated by calculating the ratio of causer layer dye gamma to receiver layer dye gamma. This analysis is described in U.S. Pat. No. 4,248,962. A larger value of the ratio indicates a greater interlayer interimage effect.

Color purity was evaluated by measuring the status M red density of the coatings after processing. A smaller value indicates a greater degree of color purity.

TABLE II

| Example No. | DIR Compound | $AMT_{35}$ | Change in $AMT_{35}$ | Gamma Causer / Gamma Receiver | Red Density |
|---|---|---|---|---|---|
| 4 (Comparison) | D-5 | 93.6 | 0 | 1.9 | 0.28 |

TABLE II-continued

| Example No. | DIR Compound | $AMT_{35}$ | Change in $AMT_{35}$ | Gamma Causer / Gamma Receiver | Red Density |
|---|---|---|---|---|---|
| 5 (Comparison) | D-6 | 93.6 | 0 | 1.9 | 0.28 |
| 6 (Comparison) | D-7 | 93.1 | −0.5 | 2.1 | 0.41 |
| 7 (Comparison) | D-2 | 93.6 | 0 | 2.1 | 0.24 |
| 8 (Invention) | I-24 | 95.2 | +1.6 | 3.4 | 0.25 |
| 9 (Invention) | I-11 | 95.5 | +1.9 | 3.4 | 0.26 |
| 10 (Invention) | I-15 | 94.8 | +1.2 | 3.4 | 0.23 |
| 11 (Invention) | I-18 | 94.8 | +1.2 | 3.6 | 0.25 |
| 12 (Invention) | I-14 | 96.8 | +3.2 | 2.3 | 0.25 |
| 13 (Invention) | I-26 | 96.0 | +2.4 | 2.2 | 0.25 |
| 14 (Invention) | I-30 | 94.2 | +0.6 | 3.5 | 0.26 |
| 15 (Invention) | I-6 | 94.8 | +1.2 | 3.6 | 0.25 |
| 16 (Invention) | I-21 | 95.8 | +2.2 | 2.0 | 0.28 |
| 17 (Invention) | I-5 | 94.2 | +0.6 | 3.5 | 0.32 |
| 18 (Invention) | I-13 | 97.0 | +3.4 | 2.3 | 0.34 |
| 19 (Invention) | I-2 | 94.8 | +1.2 | 3.8 | 0.34 |
| 20 (Invention) | I-27 | 95.3 | +1.7 | 3.4 | 0.32 |
| 21 (Invention) | I-28 | 95.5 | +1.9 | 3.4 | 0.33 |
| 22 (Invention) | I-10 | 95.6 | +2.0 | 3.5 | 0.24 |
| 23 (Invention) | I-1 | 94.8 | +1.2 | 4.7 | 0.27 |
| 24 (Invention) | I-23 | 94.8 | +1.2 | 4.5 | 0.25 |
| 25 (Invention) | I-31 | 96.8 | +3.2 | 2.7 | 0.24 |
| 26 (Invention) | I-22 | 96.8 | +3.2 | 2.7 | 0.25 |

D-5

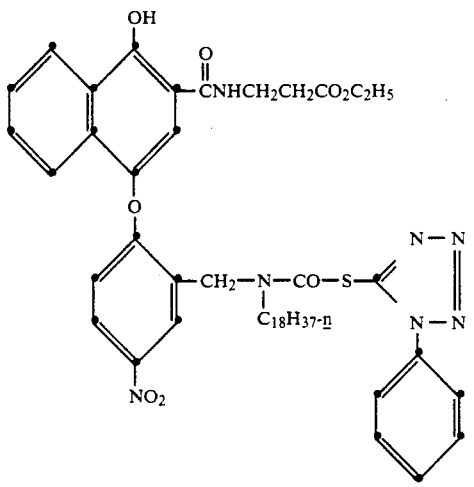

D-6

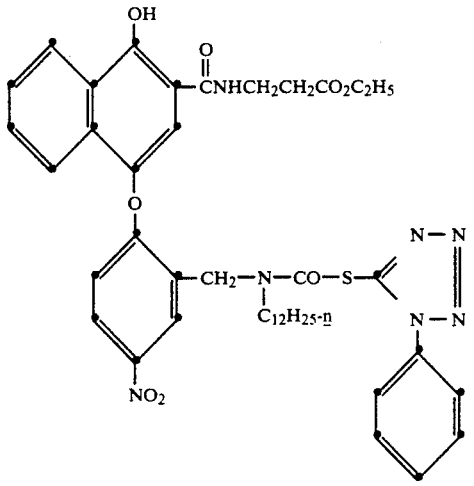

-continued

D-7

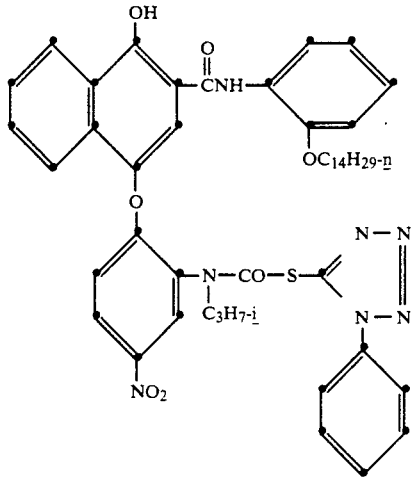

It can be seen from the interimage effects and AMT values in Table II that the use in photographic silver halide elements of couplers of the invention, which contain the described combination of groups, leads simultaneously to improved sharpness, higher interimage and lower color contamination compared to closely related compounds that do not contain such a combination of groups.

An additional feature of the invention can be illustrated by comparing the quantities of structurally similar DIR compounds of the invention required to achieve a similar degree of causer gamma suppression. Several such pairs are listed in Table III. Within each pair, the DIR compounds differ only in the number "n" defined at the generic structure on page 3. The various pairs listed in Table III differ in the identity of the released inhibitor and in the identity of the coupler moiety. In each case, although n=0 and n=1 both enable operation of the invention, lower quantities of DIR compound are used when n=0. These lower quantities are especially useful since less inhibitor and less fugitive dye are released either in a film or into processing solutions in this case. Photographic films employing DIR compounds of the invention, when n=0, are thus ecologically preferred.

TABLE III

| Example Number | DIR Compound | Quantity Required to Achieve Matched Causer Gamma (in mg/m$^2$) | n |
|---|---|---|---|
| 10 | I-15 | 225 | 1 |
| 11 | I-18 | 109 | 0 |
| 14 | I-30 | 172 | 1 |
| 15 | I-6 | 77 | 0 |
| 16 | I-21 | 472 | 1 |
| 17 | I-5 | 196 | 0 |
| 18 | I-13 | 281 | 1 |
| 19 | I-2 | 174 | 0 |
| 24 | I-23 | 288 | 1 |
| 23 | I-1 | 215 | 0 |

The invention has been described in detail with particular reference to preferred embodiments thereof, but it will be understood that variations and modifications can be effected within the spirit and scope of the invention.

What is claimed is:

1. A photographic element comprising a support bearing at least one photographic silver halide emulsion layer and a naphtholic coupler (A) containing in the 2-position a water-solubilizing group selected from $CONH_2$, $CONHCH_3$ and $CONH(CH_2)_2CO_2C_2H_5$, the coupler capable upon oxidative coupling of forming a dye that can be washed out of the element upon processing wherein the coupler (A) comprises, in the coupling position, a coupling-off group that comprises in sequence a releasable ballasted carbamate timing group and a releasable benzotriazole, triazole or tetrazole development inhibitor group, said development inhibitor group is released from the coupling-off group by a single cleavage reaction.

2. A photographic element as in claim 1 wherein the coupler is a naphtholic coupler comprising in the 2-position a —COR$^1$ group that enables the coupler upon oxidative coupling to form a dye that is capable of being washed out of the photographic element upon processing and in the 4-position a coupling-off group represented by the formula:

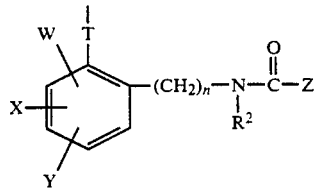

wherein

W, X, and Y individually are hydrogen or a substituent;

$R^1$ is selected from the group consisting of $NH_2$, $NHCH_3$ and $NH(CH_2)_2CO_2C_2H_5$;

$R_2$ is unsubstituted or substituted alkyl or unsubstituted or substituted aryl;

Z is a releasable benzotriazole, triazole or tetrazole development inhibitor group;

n is 0 or 1; and

T is O, S, O—$CH_2$—,

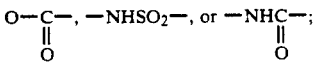

and at least one of W, X, Y, and $R^2$ is a ballasting group.

3. A photographic element as in claim 1 wherein the coupler is a naphtholic coupler comprising in the 4-position a coupling-off group that is

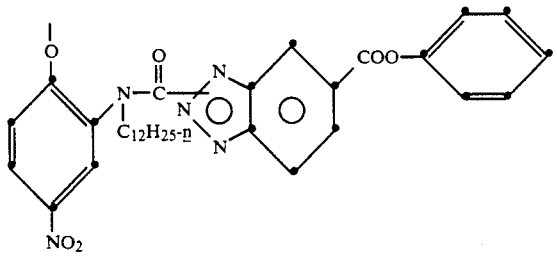

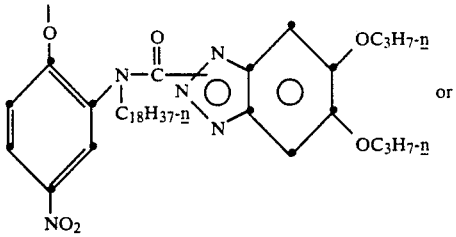

or

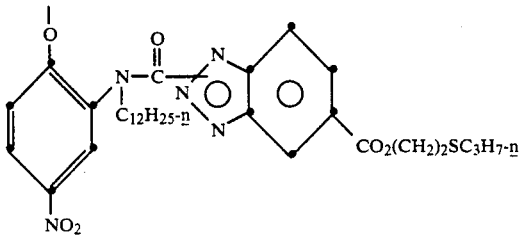

4. A photographic element as in claim 1 wherein the coupler is

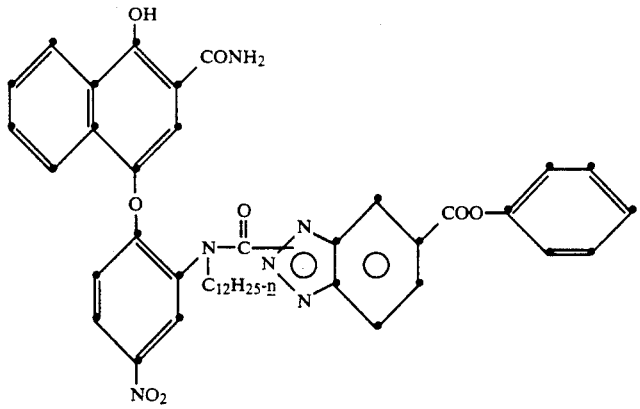

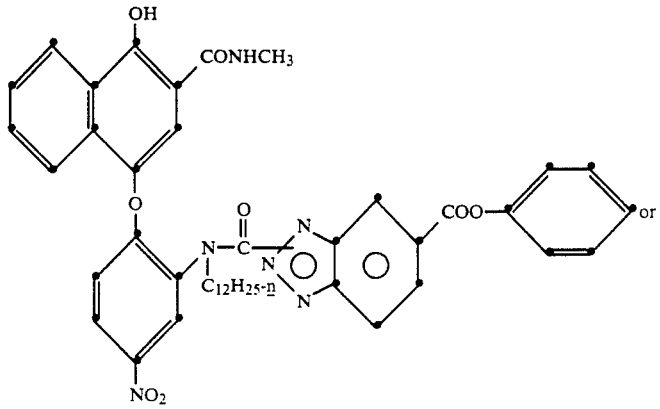

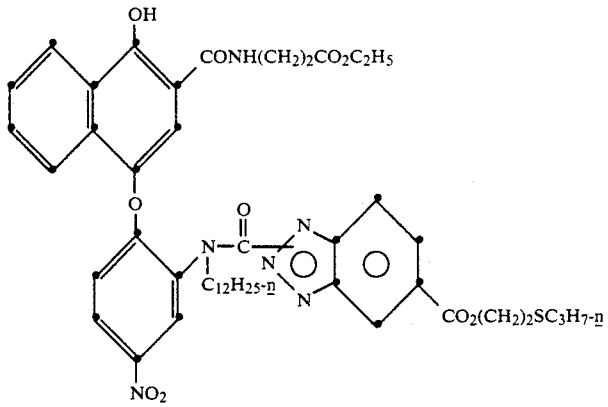

5. A process of forming a photographic image which comprises developing an exposed photographic silver halide emulsion layer with a color developing agent in the presence of a coupler (A) as defined in claim 1.

6. A process of forming a photographic image as in claim 5 wherein the coupler (A) is as defined in claim 3.

7. A process of forming a photographic image as in claim 5 wherein the coupler (A) is as defined in claim 4.

* * * * *